US006893556B2

(12) United States Patent
Yaegashi et al.

(10) Patent No.: US 6,893,556 B2
(45) Date of Patent: May 17, 2005

(54) APPARATUS FOR PRETREATMENT PRIOR TO PAINTING

(75) Inventors: Hideaki Yaegashi, Kanagawa (JP); Tsuneo Sakauchi, Yokohama (JP); Osamu Tanaka, Kanagawa (JP); Hiroyuki Kishi, Kanagawa (JP); Masahiro Obika, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/244,604

(22) Filed: Sep. 17, 2002

(65) Prior Publication Data

US 2003/0066791 A1 Apr. 10, 2003

(30) Foreign Application Priority Data

| | | |
|---|---|---|
| Sep. 17, 2001 | (JP) | 2001-281632 |
| Mar. 22, 2002 | (JP) | 2002-080515 |
| Apr. 4, 2002 | (JP) | 2002-102781 |
| Apr. 4, 2002 | (JP) | 2002-102786 |
| Apr. 9, 2002 | (JP) | 2002-106145 |

(51) Int. Cl.[7] ..... B08B 3/10

(52) U.S. Cl. ..... 210/167; 210/259; 210/416.1; 134/10; 134/109; 134/111

(58) Field of Search ..... 210/167, 175, 210/181, 222, 252, 259, 263, 321.6, 416.1, 513, 532.1, 912; 134/10, 11, 13, 109–111; 422/299, 327

(56) References Cited

U.S. PATENT DOCUMENTS 2,721,562 A * 10/1955 Irvine ..... 134/60
2,785,999 A * 3/1957 Othmar ..... 134/13
3,042,547 A * 7/1962 Pickett ..... 427/377

(Continued)

FOREIGN PATENT DOCUMENTS

| | | | |
|---|---|---|---|
| DE | 32 12 120 | A1 | 10/1983 |
| DE | 42 22 524 | A1 | 1/1994 |
| DE | 42 34 301 | A1 | 4/1994 |
| DE | 44 20 760 | C1 | 5/1995 |
| DE | 44 12 363 | A1 | 10/1995 |
| GB | 2 058 846 | A | 4/1981 |
| JP | 59-109204 | A | 6/1984 |
| JP | 61-000404 | A | 1/1986 |
| JP | 1-224003 | A | 9/1989 |
| JP | 11-033307 | A | 2/1999 |
| WO | WO 00/20658 | A1 | 4/2000 |

OTHER PUBLICATIONS

C.E. Reineke et al., "Highly Water Selective Cellulosic Polyelectrolyte Membranes for the Pervaporation of Alcohol–Water Mixtures", Journal of Membrane Science, vol. 32 (1987), pp. 207–221.

U. Sander et al., "Design and Operation of a Pervaporation Plant for Ethanol Dehydration", Journal of Membrane Science, vol. 36 (1988), pp. 463–475.

*Primary Examiner*—Fred G. Prince
(74) *Attorney, Agent, or Firm*—Foley & Lardner LLP

(57) ABSTRACT

A pretreatment apparatus for performing pretreatment before a painting process includes a treatment tank to be filled with a treatment liquid for degreasing and chemical conversion. A circuit section forms a circulation path for circulating the treatment liquid from the treatment tank to the treatment tank. A purifying section removes dust, chemical sludge and oil from the treatment liquid circulated to the treatment tank through the circulation path.

45 Claims, 15 Drawing Sheets

U.S. PATENT DOCUMENTS 3,607,482 A * 9/1971 Selm ..... 216/93
3,839,988 A * 10/1974 Duerr ..... 118/663
3,975,208 A * 8/1976 Tate et al. ..... 134/10
4,325,746 A * 4/1982 Popplewell et al. ..... 134/10
4,402,765 A * 9/1983 Goto et al. ..... 148/253
4,451,298 A * 5/1984 Yagishita et al. ..... 134/10
4,469,531 A 9/1984 Tokushima et al.
4,755,299 A 7/1988 Bruschke
4,778,532 A * 10/1988 McConnell et al. ..... 134/10
4,788,043 A * 11/1988 Kagiyama et al. ..... 422/292
4,855,023 A * 8/1989 Clark et al. ..... 134/12
4,950,505 A * 8/1990 Fogal ..... 427/327
5,174,315 A * 12/1992 Hellstern et al. ..... 134/60
5,186,758 A * 2/1993 Hartman ..... 134/10
5,236,595 A * 8/1993 Wang et al. ..... 210/669
5,248,343 A * 9/1993 Hamilton et al. ..... 134/10
5,298,082 A * 3/1994 Weitz ..... 134/40
5,397,397 A * 3/1995 Awad ..... 134/1
5,399,203 A * 3/1995 Ishikawa et al. ..... 134/10
5,409,613 A * 4/1995 Weaver ..... 210/651
5,434,332 A * 7/1995 Cash ..... 588/1
5,445,680 A * 8/1995 Hamilton ..... 134/26
5,522,940 A * 6/1996 Kitazawa et al. ..... 134/10
5,525,371 A * 6/1996 Sweeney et al. ..... 427/327
5,577,522 A * 11/1996 Barkley et al. ..... 134/111
6,308,719 B1 * 10/2001 McTighe et al. ..... 134/10
6,312,528 B1 * 11/2001 Summerfield et al. ..... 134/40
6,432,220 B1 * 8/2002 Lindemann et al. ..... 134/41

* cited by examiner

APPARATUS FOR PRETREATMENT PRIOR TO PAINTING

BACKGROUND OF THE INVENTION

The present invention relates to technique for pretreatment such as degreasing or chemical treatment to surfaces of work or metallic surfaces soiled with rust preventing oil, oil used for press forming, cutting oil, or machining oil.

Zink phosphating is widely used for metallic material such as steel or galvanized metal in order to improve the rust preventive characteristic and the paint adhesion. In general, the process of zinc phosphating includes a sequence of degreasing, rinsing, surface conditioning, chemical treatment (or zinc phosphating), rinsing, and drying. Degreasing operation, rinsing operation and surface conditioning operation may be performed a plurality of times, according to the need.

For a zinc phosphate chemical conversion coating to achieve, as a substrate layer for painting, sufficient effects of rust prevention and paint adhesion, it is desirable to obtain a uniform, fine crystalline coating having a coating weight in the range of 2~5 g/m$^2$. To obtain such a coating layer, one process employs a degreasing operation, and a surface condition operation with a titan colloid type treatment liquid.

SUMMARY OF THE INVENTION

However, in general, the process of zinc phosphating involves the following problems.

First, the entire process line is long, and the facilities are large and complicated. Accordingly, the entire system requires a large space to the disadvantage of cost, and requires a long time to the disadvantage of productivity.

Second, the number of items to be controlled is large. For example, the parameters to be controlled include; the alkalinity (total alkalinity, alkalinity of free alkali) of degreasing in the case of alkali degreasing, and the concentration (total alkali, the concentration of titanium) of surface conditioning liquid in the case of titanium colloid type surface conditioning. The complicated solution control and other control including many items to be monitored and controlled imposes a considerable burden on the operation and causes an increase in the manufacturing cost by consumption of chemicals at each step. The solution for degreasing is used up by being applied to a work and transferred to the next rinse step with the work, or at the time of periodical renewal of the solution. The liquid for surface conditioning is used up by being applied to work and at the time of renewal. Moreover, the liquid may be used up by continuous partial renewal (auto drain) when the liquid is renewed partially since the durability of the liquid is low.

Third, the amount of drainage of water for rinsing is increased. After each step of degreasing, a step of water rinsing is required to prevent the liquid for degreasing from being mixed into the surface conditioning liquid or the treatment liquid of zinc phosphating. Moreover, after a step of phosphating treatment, a step of water rinsing is required since the treatment liquid remaining on surfaces could cause troubles to surface conditioning and rust prevention. The large amount of rinsing liquid drained at the rinsing steps after the degreasing and chemical treatment steps is burdensome to the waste water treatment.

It is an object of the present invention to provide pretreatment apparatus for painting or coating which can shorten the process.

According to the present invention, a pretreatment apparatus for performing pretreatment before a painting process, comprises: a liquid container section including a treatment section which includes a treatment tank to be filled with a treatment liquid for degreasing and chemical conversion; a circuit section to form a circulation path for circulating the treatment liquid from the treatment tank to the liquid container section; and a purifying section to remove an unwanted constituent from the treatment liquid circulated to the container section through the circulation path.

According to another aspect of the present invention, a pretreatment apparatus comprises: a liquid container section including a treatment section which includes a treatment tank to be filled with a treatment liquid for degreasing and chemical conversion; a settling tank to receive the treatment liquid from the treatment tank; and a purifying apparatus to separate an unwanted constituent from the treatment liquid in settling tank. According to still another aspect of the present invention, a pretreatment apparatus comprises: a liquid container section including a treatment section which includes a treatment tank to be filled with a treatment liquid for degreasing and chemical conversion; and a spray zone, disposed at a stage prior to a stage of the treatment tank, and arranged to spray a spray liquid for degreasing and chemical conversion to a work to be painted.

The other objects and features of this invention will become understood from the following description with reference to the accompanying drawings.

DETAILED DESCRIPTION OF THE INVENTION

Figure 1:
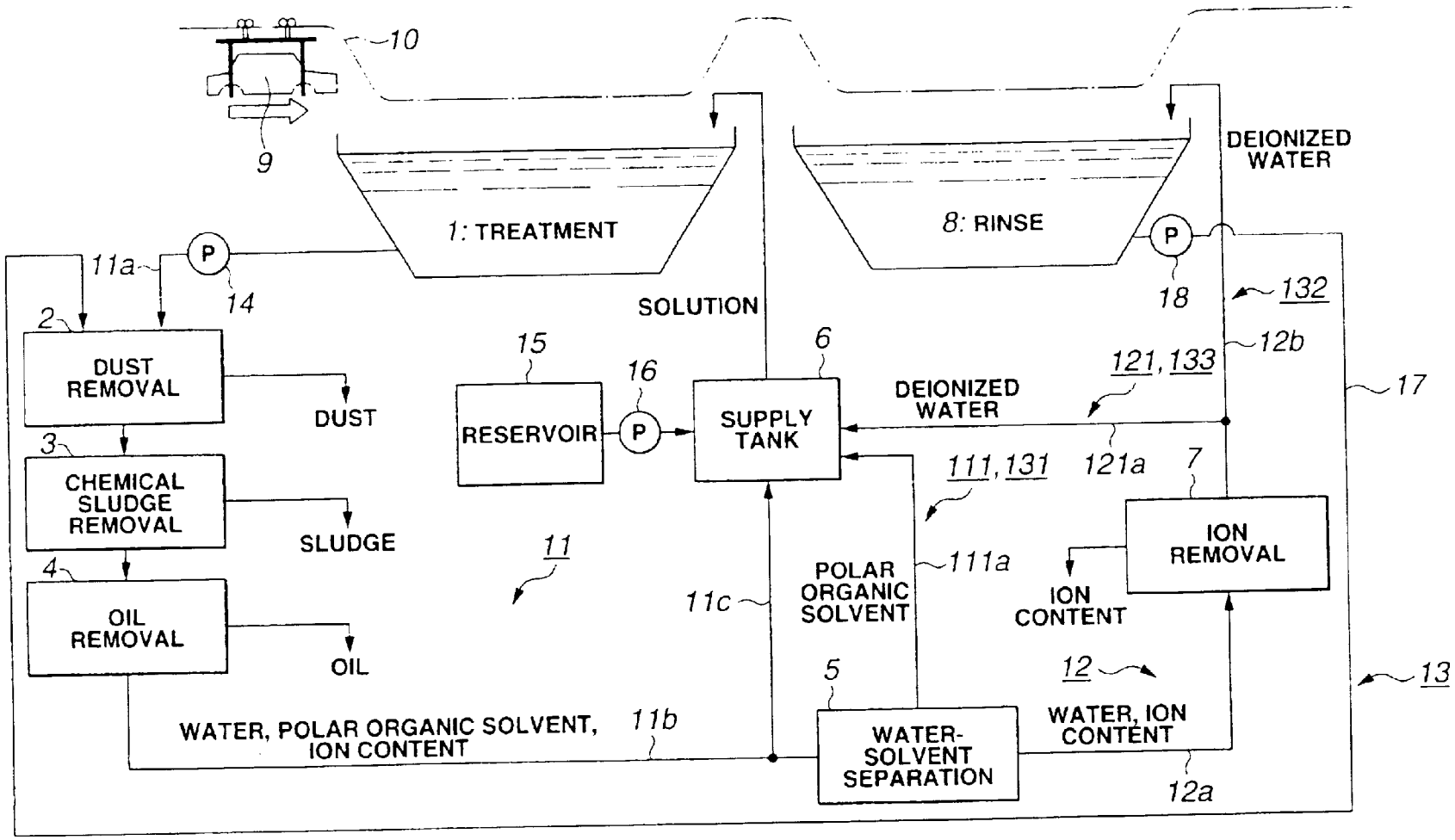
FIG. 1 is a schematic view showing a pretreatment apparatus (or equipment) according to a first embodiment of the present invention.

FIG. 1 shows apparatus or equipment, according to a first embodiment of the present invention, for a process for pretreatment which is given to a work such as an automobile body for degreasing, surface conditioning and chemical treatment prior to painting or coating. Automobile body 9 is suspended and conveyed by a conveyor 10 for a painting line. Two dipping tanks 1 and 8 are situated along conveyor 10 and the tank 1 situated upstream of the other tank 8 as viewed in the direction of travel of automobile body 9 which is shown by an arrow is a treatment tank filled with a treatment liquid or solution for both degreasing and chemical conversion coating of automobile body 9. Tank 8 on the downstream side is a rinse tank filled with a rinsing liquid, such pure water or deionized water, for rinsing automobile body 9 as treated. In this example, a liquid container section for storing one or more liquids includes a treatment section of tank 1 (and a tank 6) and a rinse section of rinse tank 8.

The treatment solution is used for carrying out three kinds of treatment, i.e. degreasing, surface conditioning and chemical conversion treatment, at a single step. For example, the treatment solution contains at least a polar organic solvent, water and an ion content. The polar organic solvent may be of the type selected from alcohols, glycol ethers and diethylene glycol ethers. In this example, the polar organic solvent comprises at least one of alcohols, glycol ethers and diethylene glycol ethers. The ion content may contain zinc ions, phosphoric acid ions, manganese ions, nickel ions and/or sodium ions. By using the treatment liquid of such a type, the apparatus according to this embodiment can carry out all of degreasing, surface conditioning and chemical treatment at a single step. Therefore, this embodiment can greatly reduce time for treatment, simplify the facilities for treatment, reduce the space required for treatment, improve the productivity, reduce the cost for the required chemicals, and simplify the control of the chemicals.

Treatment tank 1 is provided with a circulating line 11 (or treatment-side circulation path) for drawing out the treatment solution from the tank 1 by a pump 14 and returning the treatment solution to treatment tank 1, as shown in FIG. 1. In circulating line 11, there are provided a dust removing apparatus (or section) 2, a chemical sludge removing apparatus (or section) 3 and an oil removing apparatus (or section) 4 which are situated one upstream of another. A line segment 11*a* forms a part of the circulation line 11 by extending from pump 14 to dust removing section 2.

Dust removing apparatus 2 removes foreign matter, such as iron dust or iron powder, from the treatment solution in treatment tank 1 and the rinsing liquid in rinse tank 8. The solution from which foreign matter has been removed is conveyed to chemical sludge removing apparatus 3, while the foreign matter which has been removed is disposed of properly. More specifically, the apparatus 2 may be composed of a settling tank, or a centrifugal separator or a magnetic separator, as will hereinafter be described in detail.

Figure 2A:
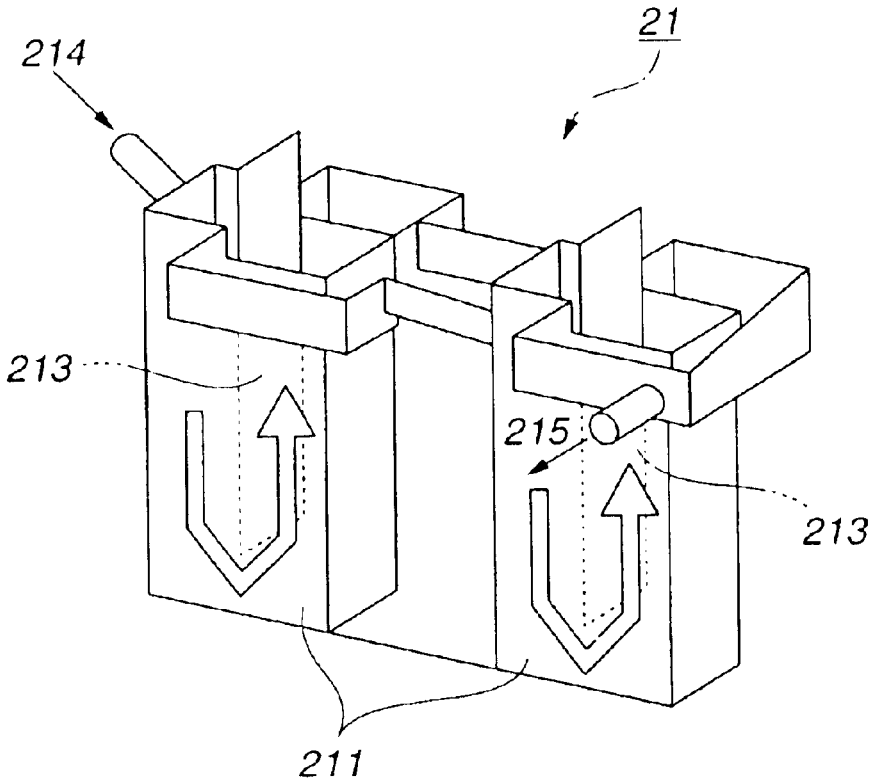
FIGS. 2A and 2B are perspective and sectional views showing a first dust removing apparatus which can be employed in the pretreatment apparatus of FIG. 1.
Figure 2B:
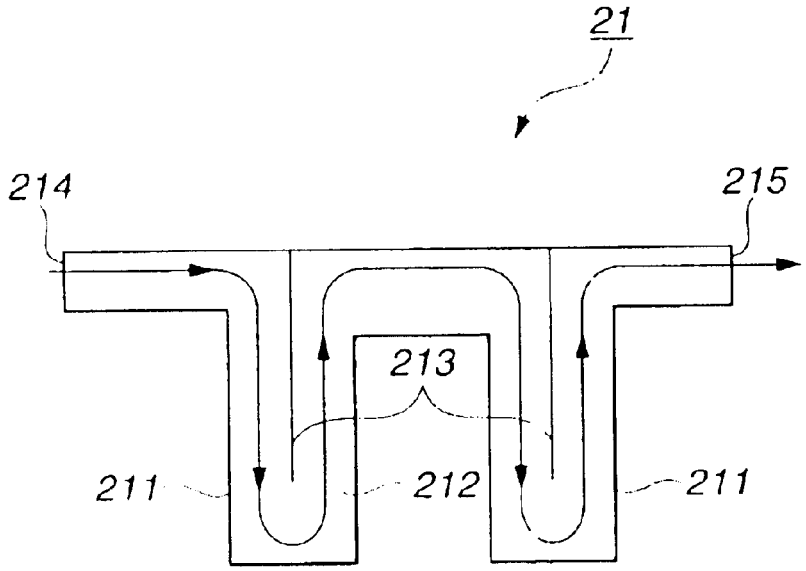

A settling tank 21 is shown in FIG. 2 as one form of dust removing apparatus 2, and includes a tank 211 having a flow passage 212 curved by partitions 213, an inlet 214 for the solution to be cleaned and an outlet 215 through which it flows out after passing through the meandering passage 213. The solution is caused to rise or flow upward in the tank 211 at a speed which is lower than the falling speed of dust matter, such as iron dust, so that dust matter may settle in the bottom of tank 211. Settling tank 21 is inexpensive because of its simple construction, and effective for removing dust of relatively heavy weight other than what is floating in the solution.

Figure 3:
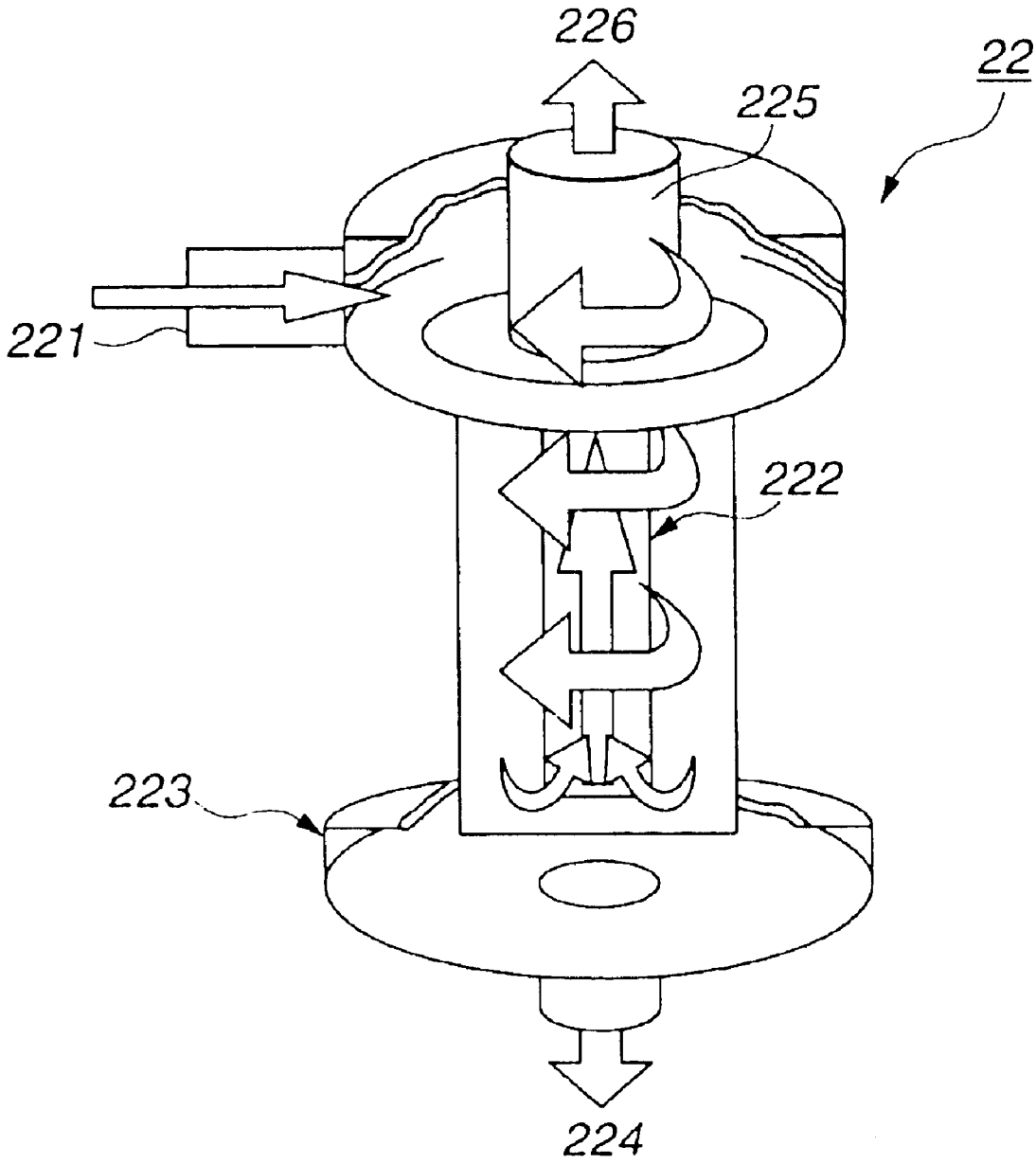
FIG. 3 is a perspective view showing a second dust removing apparatus which can be employed in the pretreatment apparatus of FIG. 1.

A centrifugal separator 22 is shown in FIG. 3 as another form of dust removing apparatus 2 and has a tangentially extending special rotary mechanism 222 in the form of a slit through which the solution entering it at an inlet 221 and containing foreign matter, such as iron dust, is caused to flow at an accelerated speed, so that the solid or foreign matter having a greater weight than the liquid may be centrifugally separated, collected along the inner wall into a lower collection chamber 223 and removed through a solid outlet 224, while the solution is caused to rise through an inner tube 225 and flow out through an outlet 226.

Figure 4:
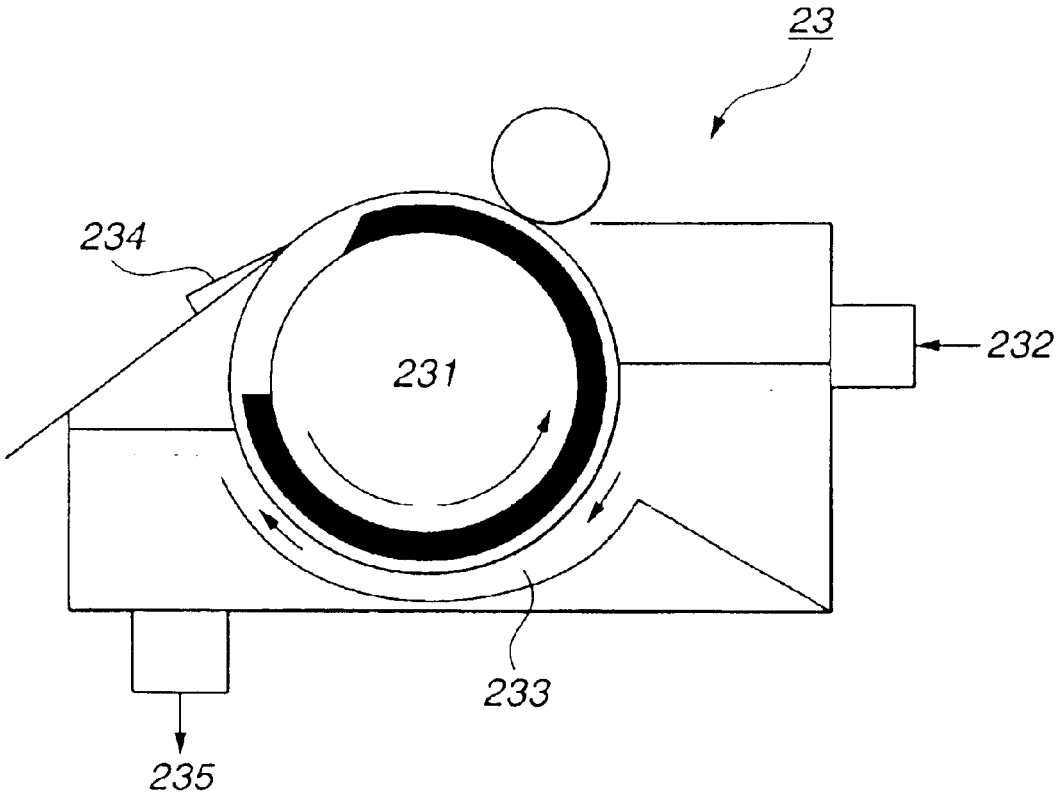
FIG. 4 is a sectional view showing a third dust removing apparatus which can be employed in the pretreatment apparatus of FIG. 1.

A magnetic separator 23 is shown in FIG. 4 as still another form of dust removing apparatus 2 and has a magnetic drum 231 for removing magnetic foreign matter, such as iron dust, from the solution entering through an inlet 232 and flowing through a passage 233 extending along the drum 231. Drum 231 rotates in the counterclockwise direction in FIG. 4. The foreign matter which has been attracted to the drum 231 magnetically is removed therefrom by a scraper 234 and the solution from which foreign matter has been removed is discharged through an outlet 235.

Dust removing apparatus 21, 22 and 23 may be employed singly or in combination. A combination of settling tank 21 and magnetic separator 23 is preferable for its highly effective removal of foreign matter.

The dust removing apparatus is, however, not limited to these three forms as described above, or any combination thereof, but may be of any other type or construction. Although it has been described as being situated in the circulating line 11, the dust removing apparatus 2 may alternatively be situated inside treatment tank 1 or on the outside of tank 1, away from the circulating line 11.

Chemical sludge removing apparatus 3 removes a chemical sludge from the solution arriving from dust removing apparatus 2. The solution from which a chemical sludge has been removed is conveyed to oil removing apparatus 4, while the sludge is disposed of properly. The apparatus 3 may include any filter that can maintain a sludge concentration within 150 ppm in the solution in the treatment tank 1 as shown in FIG. 1, and maintain the solution free from contamination. The filter may be a filter for dead end filtration.

Oil removing apparatus 4 removes oil from the solution arriving from chemical sludge removing apparatus 3. The solution from which oil has been removed is conveyed through a line segment 11*b*, to a solution storage tank or supply tank 6, as well as a water-polar organic solvent separator or separating section 5.

Oil removing apparatus 4 may be of a heating type oil removing apparatus, a coalescer type oil removing apparatus, or an ultrafiltration type oil removing apparatus. The heating type apparatus is suitable for application to an aqueous solution containing a nonionic surface active agent as a degreasing substance, since a nonionic surface active agent becomes insoluble in water when heated to a temperature equal to or higher than a predetermined temperature, so that the solution may be separated into an oil phase composed of the nonionic surface active agent and a water phase.

The coalescer type oil removing apparatus collects oil drops having a size of several microns ($\mu$m) from an aqueous solution by passing them through a filter to destroy a water-oil emulsion and thereby to cause the oil drops to grow large, so that floats are collected.

The ultrafiltration type oil removing apparatus employs a filter for ultrafiltration, having a mesh size of about 0.001 to 0.01 micron (0.01~0.001 $\mu$m) for filtration at a low pressure in the order of about $5\times10^{-5}$ to 0.5 Pa ($0.5\sim5\times10^{-5}$ Pa) or under suction to separate colloidal particles from the solvent.

These types of oil removing apparatus 4 may be employed singly or in combination, depending on the degree of oil and water separation as required.

Solution storage tank or supply tank 6, water-polar organic solvent separator 5 and ion removing apparatus 7 are situated downstream of oil removing apparatus 4 in the circulating line 11, as shown in FIG. 1.

Solution storage tank 6 temporarily stores the treatment solution purified by the removal section of dust, chemical sludge and oil removing apparatus 2, 3 and 4. The treatment solution is conveyed to solution storage tank 6 by a line segment 11*c*. Solution storage tank 6 is connected with line segment 11*c* for supplying the treatment liquid from oil removing apparatus 4 to solution storage tank 6, a line segment 111*a* for conveying a polar organic solvent from the water-polar organic solvent separator 5 to solution storage tank 6, and a line segment 121*a* for conveying water from ion removing apparatus 7, as will hereinafter be described. Solution storage tank 6 returns the solution to treatment tank 1 with a fresh solution supplied from a solution reservoir 15 through a pump 16.

Water-solvent separator 5 separates the solution received from oil removing apparatus 4, into a water content and a polar organic solvent content, and delivers the water content to ion removing apparatus 7 through a line segment 12*a*, and the polar organic solvent content to solution storage tank 6 through a line segment 11*a*.

Figure 5:
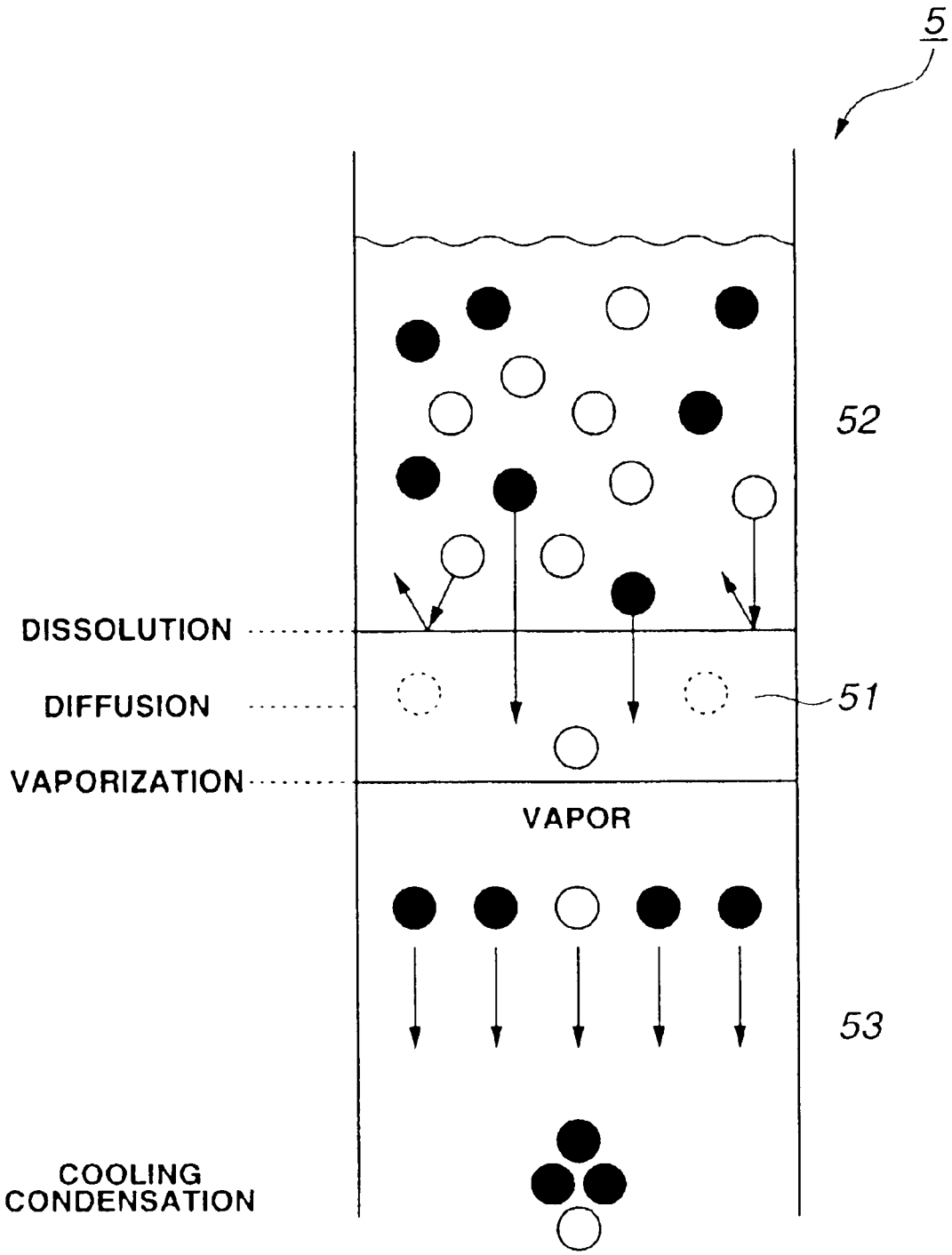
FIG. 5 is a schematic view illustrating a water polar organic solvent separating apparatus which can be employed in the pretreatment apparatus of FIG. 1.

Water-solvent separator 5 is preferably arranged to carry out an efficient and inexpensive separation of water from a polar organic solvent of the type selected from alcohols, glycol ethers or diethylene glycol ethers as stated before. One example is a separating method called pervaporation, employing a separating membrane having selective permeability, i.e. showing a markedly different rate of diffusion from one kind of substance to another. Referring to FIG. 5, a mixture of a polar organic solvent and water is fed to a separating membrane 51 (a non-porous membrane having pores with a diameter not exceeding 1 nm) on one (or feed) side 52 thereof and a vacuum, or reduced pressure is created on the other (or permeation) side 53 thereof. The difference in pressure between the feed and permeation sides 52 and 53 of the membrane 51 produces a force for driving the solvent and water mixture from the high pressure (or feed) side 52 of the membrane 51 to its low pressure (or permeation) side 53, so that the solvent and water may be separated from each other owing to the selective permeability of the membrane 51.

Specific examples of such membrane 51 are: a composite membrane formed by placing a PVA film crosslinked with maleic acid on a supporting film (shown in Japanese Published Patent Application Publication No. S59(1984)-109204); a membrane formed from a mixture containing 80% of carboxymethyl cellulose and 20% of polyacrylate, and treated with a K salt [J. Memb. Sci., 32, 207 (1987)], a composite membrane formed by placing a crosslinked PVA film on a supporting film of PNA [J. Memb. Sci., 36, 463 (1988)], a membrane formed from hollow yarns of a chitosan derivative [Annual Meeting of The Japan Chemical Society (1989)], a cobalt alginate membrane (Japanese Published Patent Application Publication No. S61(1986)-404), a membrane of a sulfate of chitosan [The International Membrane Society (1987)], and a composite membrane of a polyion complex of polyacrylic acid and ionene type polycation as formed by hydrolyzing the surface of a base film of PNA (Japanese Published Patent Application Publication No. H01(1989)-224003).

Figure 6:
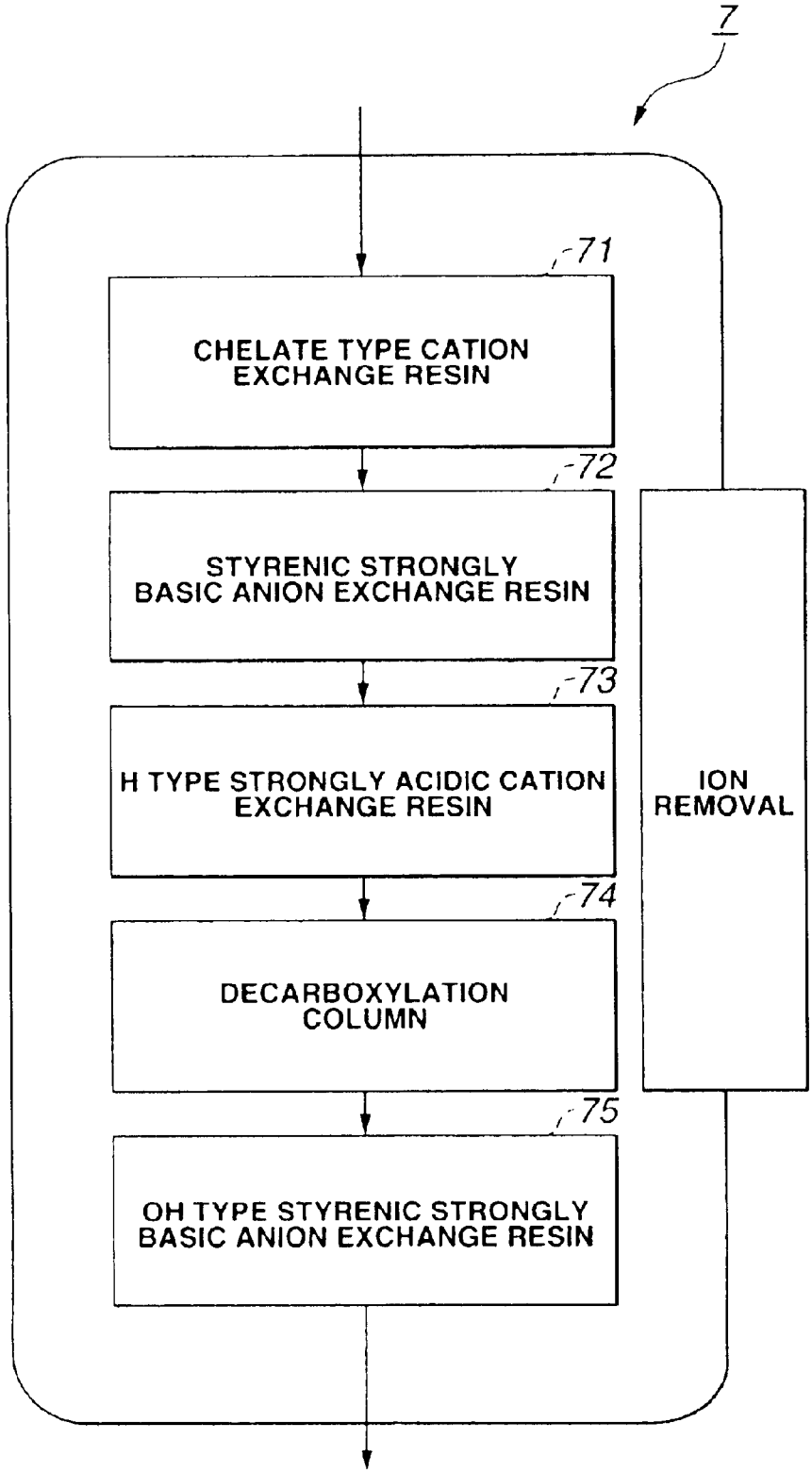
FIG. 6 is a schematic view showing an ion removing apparatus which can be employed in the pretreatment apparatus of FIG. 1.

Ion removing apparatus 7 removes ions from the water delivered from water-solvent separator 5. The ions are disposed of properly and the remaining water is supplied to the solution storage tank 6 by a line segment 121*a* and the rinse tank 8 by a line segment 12*b*. Ion removing apparatus 7 need not be special apparatus, but may be of the type shown in FIG. 6. Ion removing apparatus 7 shown in FIG. 6 has an ion exchange column 71 containing a chelate type cation exchange resin capable of removing cations, such as zinc, nickel and manganese ions, from the treatment solution, and an ion exchange column 72 containing a styrenic strongly basic anion exchange resin capable of removing anions, such as phosphate and nitrate groups. Ion removing apparatus 7 of FIG. 6 further includes an ion exchange column 73 containing an H type strongly acidic cation exchange resin, a decarboxylation column 74 and an ion exchange column 75 containing an OH type styrenic strongly basic anion exchange resin. Ion removing apparatus 7 is water purifying apparatus.

The thus-constructed pretreatment apparatus according to one embodiment of the present invention as described above includes a plurality of circulating lines or circuits, as shown in FIG. 1 and as stated below.

First circulation line 11 (or treatment-side circulation path) is a circuit for circulating the treatment solution through treatment tank 1, dust removing apparatus 2, chemical sludge removing apparatus 3, oil removing apparatus 4, and solution storage tank 6, and returning it to the tank 1, as described before.

A second circulating line 12 (or rinse-side circulation path) is a circuit for circulating the treatment solution through treatment tank 1, dust removing apparatus 2, chemical sludge removing apparatus 3, oil removing apparatus 4, water-solvent separator 5, ion removing apparatus 7, and rinse tank 8.

A third circulating line 13 (or rinse return path) is a circuit for conveying the liquid from rinse tank 8 to dust removing apparatus 2 through a pipeline 17 and a pump 18, and circulating the liquid through dust, chemical sludge and oil removing apparatus 2, 3 and 4.

Five more circulating lines are provided as shown in FIG. 1. A fourth circulating line 111 (or solvent circuit path) is a circuit defined by adding water-solvent separator 5 in the closed circuit defined by first circulating line 11, so that the polar organic solvent is delivered from separator 5 to solution storage tank 6.

A fifth circulating line 121 (or water circuit path) is a circuit defined by adding solution storage tank 6 to the closed circuit defined by the second circulating line 12, so that part of pure water or deionized water obtained by removing ions in the ion removing apparatus 7 is delivered to tank 6.

A sixth circulating line 131 is a circuit defined by adding water-solvent separator 5 to the closed circuit defined by the third circulating line 13, so that the polar organic solvent leaving the separator 5 may be delivered to the solution storage tank 6.

A seventh circulating line 132 is a circuit defined by adding ion removing apparatus 7 in the closed circuit defined by the sixth circulating line 131, so that ions may be removed from water separated by the water-solvent separator 5 and the resulting water may be delivered to the rinse tank 8.

An eighth circulating line 133 is a circuit defined by adding ion removing apparatus 7 to the closed circuit defined by sixth circulating line 131, so that ions may be removed from water separated by the water-solvent separator 5 and the resulting water may be delivered to the solution storage tank 6.

Owing to its first to third circulating lines as its main circulating lines, or a total of eight circulating lines, the apparatus according to the embodiment of this invention can stabilize the composition of the treatment solution in treatment tank 1, and thereby form an excellent chemical conversion coating of uniform quality even in a continuous operation.

With third circulating line 13, this embodiment makes it possible to maintain the electric conductivity of water in rinse tank 8 at a level equal to or lower than 20 $\mu$S/cm and thereby prevent any foreign matter, such as oil, solution or iron dust, from adhering to the surface of any treated product and being carried forward to any later work station.

In this example, a circuit section to form a circulation path includes items 11*a*, 11*b*, 11*c*, 12*a*, 12*b*, 14, 17, 18, 111*a* and 121*a*, and a purifying section to remove an unwanted constituent from the treatment liquid includes items 2, 3, 4, 5 and 7.

Figure 7:
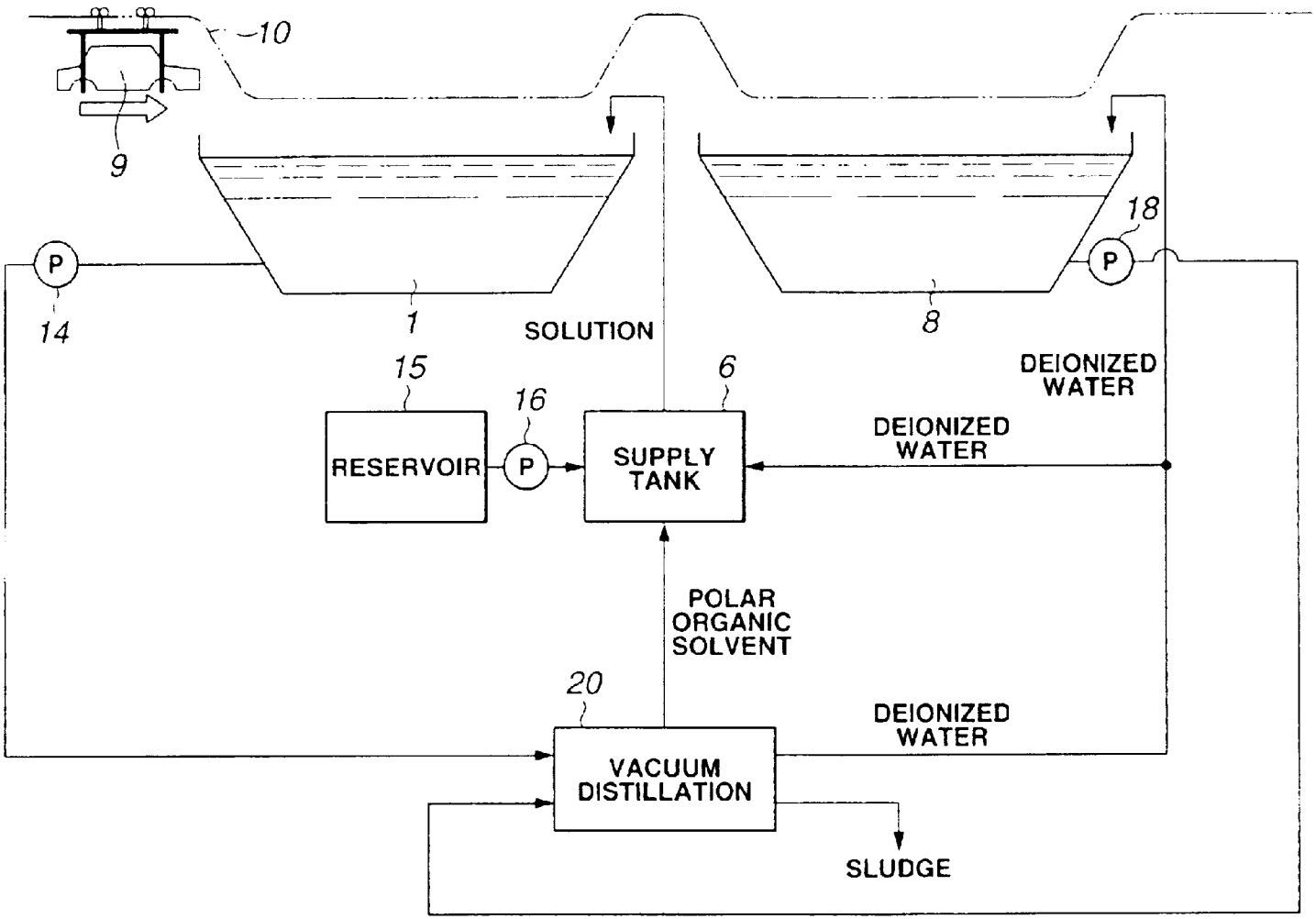
FIG. 7 is a schematic view showing a pretreatment apparatus (or equipment) according to a second embodiment of the present invention.
Figure 8:
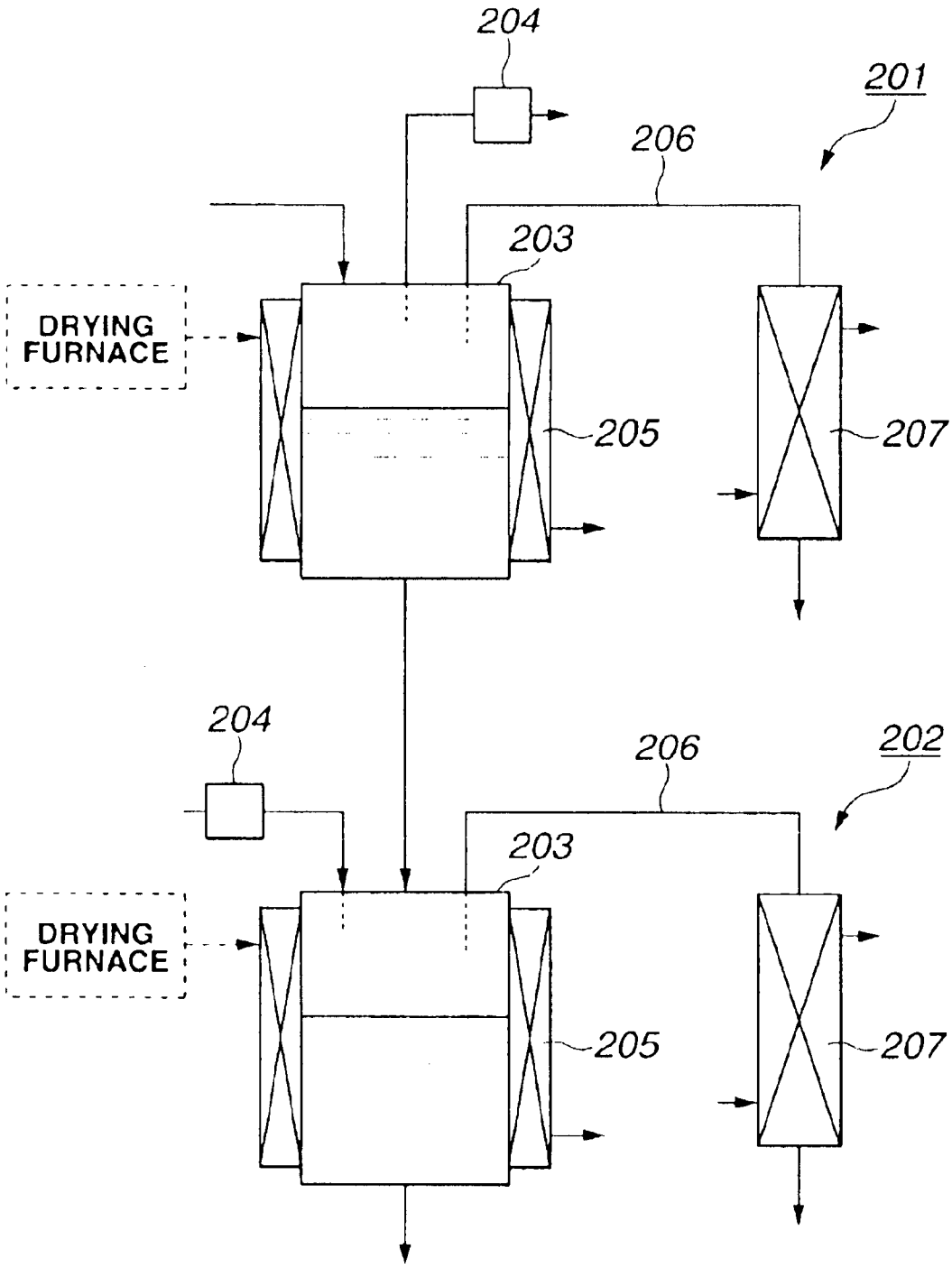
FIG. 8 is a schematic view showing a vacuum distillation apparatus which can be employed in the pretreatment apparatus of FIG. 7.

FIGS. 7 and 8 show a pretreatment apparatus according to a second embodiment of the present invention.

The pretreatment apparatus according to the second embodiment employs a vacuum distillation apparatus 20 in place of dust, sludge and oil removing apparatus 2 to 4, water-solvent separator 5 and ion removing apparatus 7 shown in FIG. 1.

The treatment solution of treatment tank 1 and the rinsing liquid of rinse tank 8 are sucked, respectively, by pumps 14 and 18, and supplied, respectively, to vacuum distillation apparatus 20, which separates the polar organic solvent and water from each other and from other substances. The solvent and a part of water as separated are delivered to solution storage tank or supply tank 6, and the remaining water to rinse tank 8.

The other substances include solid matter, such as iron dust, chemical sludge and oil, and are discharged from vacuum distillation apparatus 20 and disposed of properly.

FIG. 8 shows vacuum distillation apparatus 10 more in detail. Vacuum distillation is a method of distillation which is carried out at a reduced pressure in the order of $10^{-2}$ to several tens of Torr, for example, and therefore at a correspondingly low boiling point. In the example of FIG. 8, there are provided two vacuum distillation apparatus 201 and 202 for separating the polar organic solvent and water, respectively, from the treatment solution. They are of the same construction and each of them has a main body 203 which is fed with the solution and evacuated by a vacuum pump 204. The main body 203 is provided with a heater 205 for heating the interior of main body 203 to an appropriate temperature to heat the solution in main body 203 at a reduced pressure, so that if any substance is heated to its boiling point, only that substance may be vaporized, conveyed through a vapor tube 206, and liquefied in a condenser 207.

The first vacuum distillation apparatus 201 separates only the polar organic solvent from the solution and delivers the solvent to solution storage tank 6 shown in FIG. 7. The second vacuum distillation apparatus 202 separates only water from the solution arriving from first apparatus 201 and delivers the water content to solution storage tank 6 and rinse tank 8. The dust, sludge and oil as separated in vacuum distillation apparatus 202 are disposed of properly.

The lowering of the boiling point by the reduction of the pressure makes it possible to reduce the required amount of heat energy supplied to each heater 205 as compared to the distillation at a normal pressure. Specifically, it is desirable to employ waste heat from a paint drying furnace or oven as a source of heat energy for the heaters 205.

The pretreatment apparatus of the second embodiment can recover and regenerate the liquids for treatment tank 1 and rinse tank 8 only with vacuum distillation apparatus 20, so that the system is simplified and the cost is reduced, as compared with the first embodiment.

The embodiments explained above are described not for limiting the invention but the purpose of the help to understand the invention. Accordingly, each element disclosed in the embodiments described above is to be understood that it includes any alternation of the design belonging to the invention and equivalents thereof.

The invention will now be described in further detail by way of a few specific examples to confirm the effects.

A treatment solution for degreasing and zinc phosphate treatment was prepared by mixing 500 g of water, 500 g of diethyleneglycol monoethyl ether, 100 g of sodium nitrate, 4.3 g of orthophosphoric acid, 15.9 g of zinc nitrate, 6.2 g of nickel nitrate, 4.1 g of manganese nitrate and 6.2 g of lithium nitrate.

Dust removing apparatus 2 which was employed was a combination of a settling tank and a magnetic separator (made by Brin Co., Ltd.). The chemical sludge removing apparatus 3 was a total filter (made by Nitto Denko Co., Ltd.) having a filtering capacity to maintain a sludge concentration not exceeding 150 ppm in the treatment tank 1. The oil removing apparatus 4 was Pearlcomb oil removing apparatus (made by Central Filter Manufacturing Co., Ltd.) having a combination of coalescent and ultrafiltration type apparatus.

Water-solvent separator 5 was of the type having a separating membrane of a chitosan derivative (product of LIGNYTE Co., Ltd.), and was operated by employing a temperature of 50 deg. C. and a pressure of 0.01 mHg on its permeation or low pressure side. Ion removing apparatus 7 was of the type employing a chelate type cation exchange resin (DIAION CR10 of Mitsubishi Chemical Corportaion), a styrenic strongly basic anion exchange resin (DIAION SA20A of Mitsubishi Chemical Corporation) and a styrenic strong acidic cation exchange resin (DIAION SK1B of Mitsubishi Chemical Corporation).

A mixture containing three kinds of rustproofing oil, Rust Clean K (product of Cosmo Oil Co., Ltd.), Idemitsu NR3 (product of Idemitsu Kosan Co., Ltd.) and NonRust PN-1 (product of Nisseki Mitsubishi Co., Ltd.), in equal proportions was employed to form an oil coating having any of three amounts (a weight of 0.5 g/m$^2$, 1 g/m$^2$, 2 g/m$^2$) on each of 2000 SPCC-SD steel sheets having a width of 70 mm, a length of 150 mm and a thickness of 0.8 mm, and each sheet was subjected to treatment by employing the solution and apparatus as described above. The examples were designated as Examples 1 to 3 respectively to the weight of the oil coating. The results are shown in Table 1 placed at the end of "Detailed Description of the Invention".

As Comparative Example 1, a test was conducted by employing the above-described rustproofing oil to form an oil coating having a weight of 0.5 g/m$^2$ on each sheet and then subjecting them to treatment in a beaker filled with the above-described solution. The results are shown in Table 1.

As Comparative Example 2, a test was conducted by dipping each sheet in acetone after coating it with the oil mixture, and wiping it with a piece of cloth or gauze for degreasing, and then subjecting them to treatment in a beaker filled with the above-described solution. The results are shown in Table 1.

The results shown in Table 1 were obtained by examining the appearance of a zinc phosphate film on each of 2000 sheets in a SEM photograph of 1000 magnifications. In Table 1, each double circle indicates very good results, each circle indicates good results, each triangle indicates poor results, and each x indicates bad results.

As is obvious from Table 1, the apparatus according to each of the preceding embodiments was found capable of maintaining high quality of zinc phosphate treatment even for a large number of oil-coated steel sheets, while acetone wiping according to Comparative Example 2 was equally effective. It was also confirmed that these embodiments made it possible to carry out any such treatment in a closed circuit.

Figure 9:
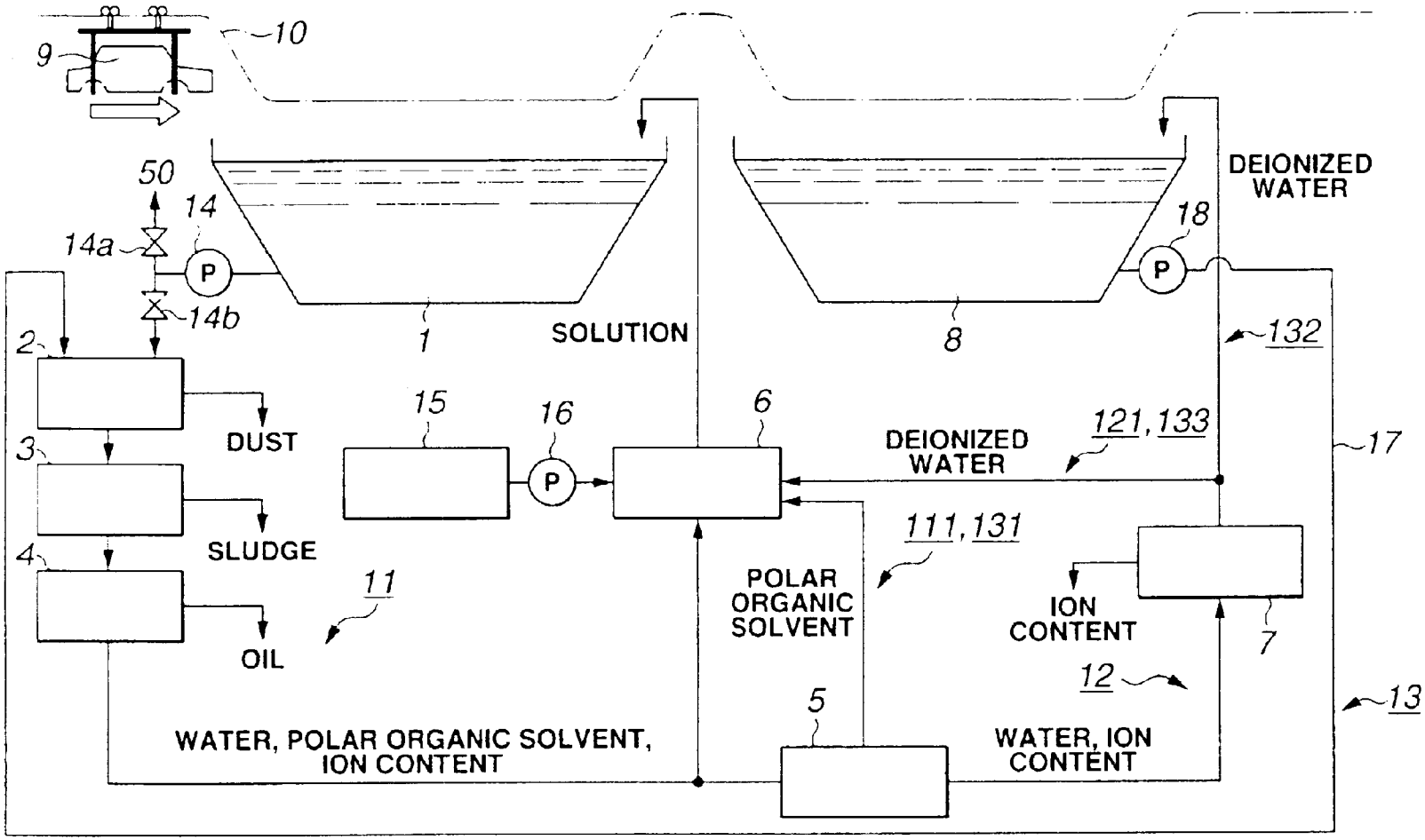
FIG. 9 is a schematic view showing a pretreatment apparatus (or equipment) according to a third embodiment of the present invention.
Figure 10:
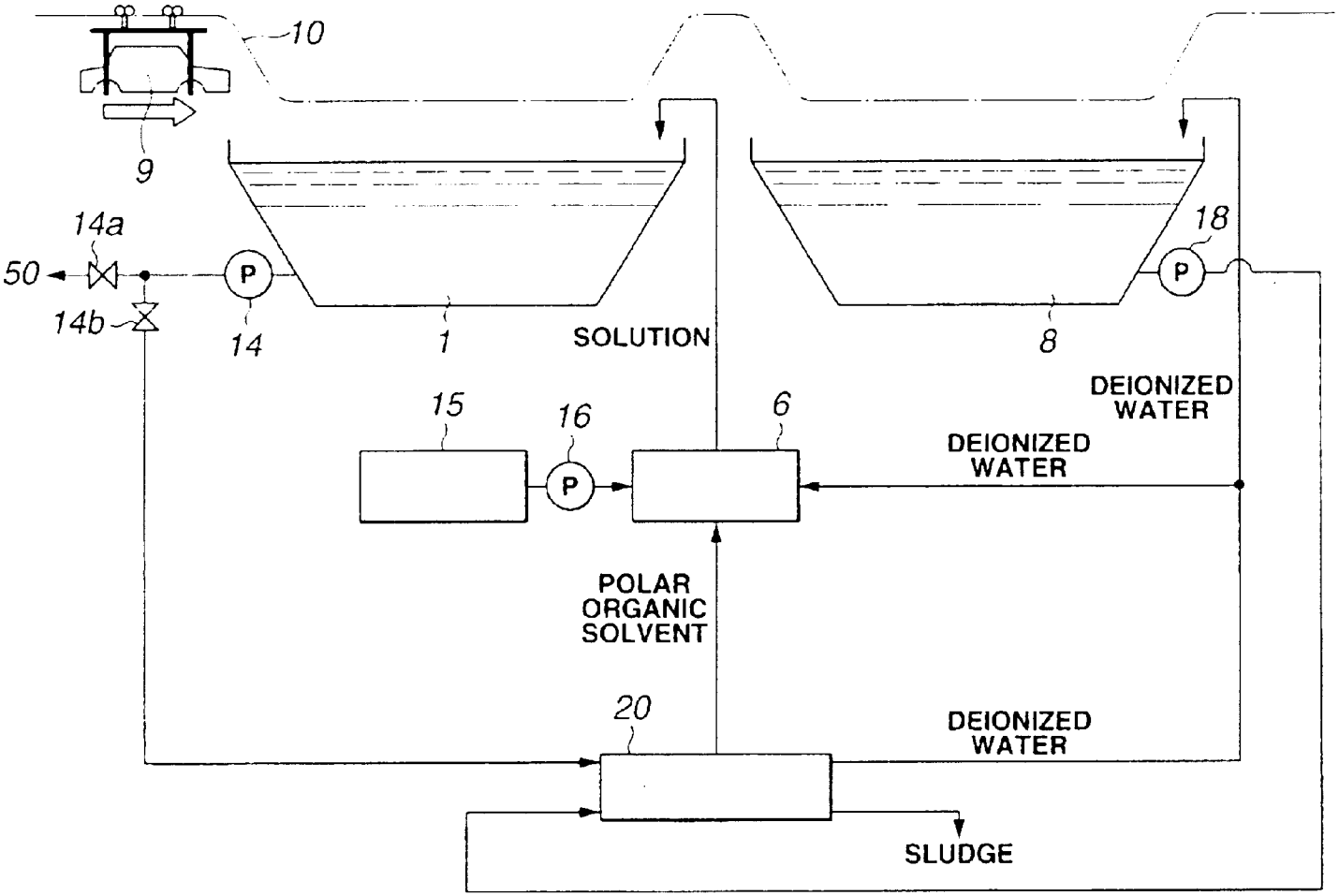
FIG. 10 is a schematic view showing a pretreatment apparatus (or equipment) according to a fourth embodiment of the present invention.
Figure 11:
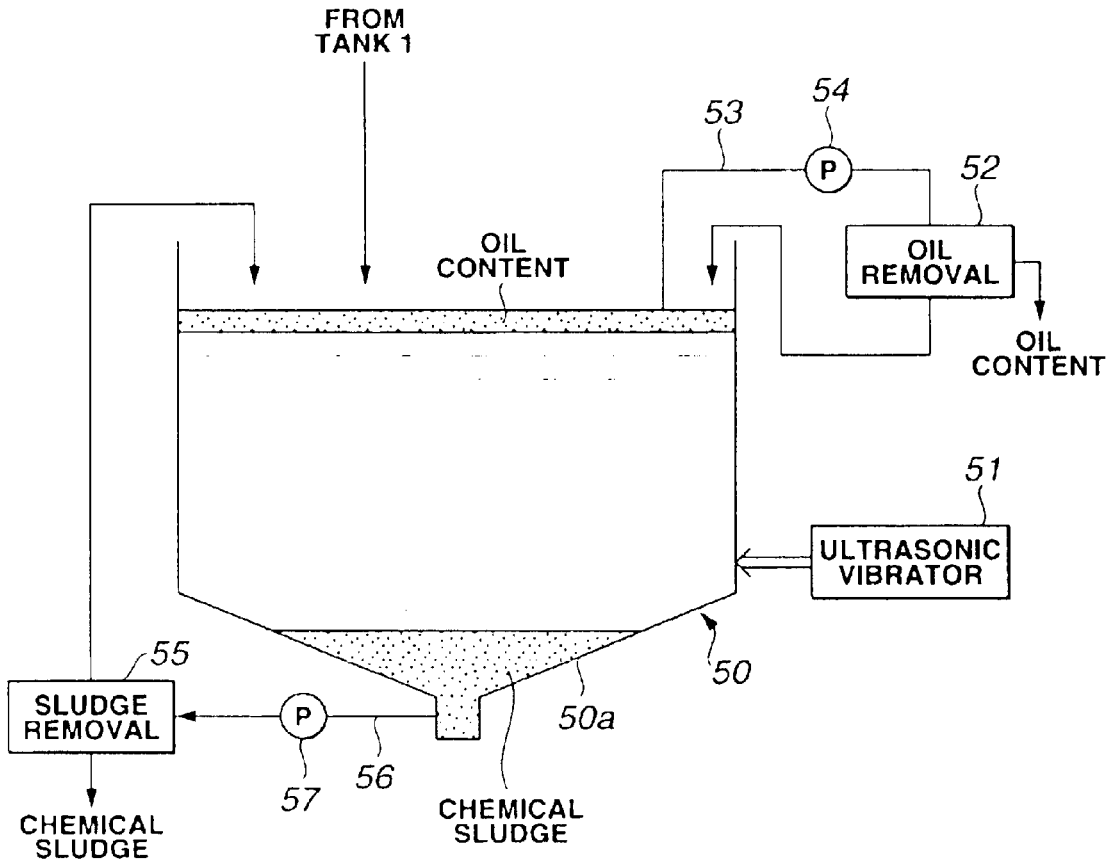
FIG. 11 is a schematic view showing a settling tank which can be employed in the pretreatment apparatus of FIG. 9 or 10.

FIGS. 9 and 10 show, respectively, pretreatment apparatus according to a third embodiment and a fourth embodiment of the present invention. The pretreatment apparatus of FIGS. 9 and 10 are similar to the two apparatus of FIG. 1 and FIG. 7, respectively. However, each of the apparatus of FIG. 9 and FIG. 10 includes a settling tank 50 as shown in FIG. 11. Settling tank 50 is connected with treatment tank 1 through a pump 14 and a valve 14*a*. On the downstream side of pump 14, fluid conduit is bifurcated into two branches, one leading to settling tank 50 through valve 14*a*, and the other leading to dust removing section 2 in the case of FIG. 9 or to vacuum distillation apparatus 20 in the case of FIG. 10, through valve 14*b*. Valves 14*a* and 14*b* serve as a switching device. Therefore, it is possible to transfer the treatment liquid from treatment tank 1 to settling tank 50.

FIG. 11 shows settling tank 50 which can be employed in the system of FIG. 9 or in the system of FIG. 10. Settling tank 50 of this example has a capacity of receiving almost all the total amount of treatment liquid in treatment tank 1. The liquid is transferred from treatment tank 1 to settling tank 50 at downtime on a day off, for cleaning treatment tank 1, for example.

An ultrasonic vibrating machine 51 is provided to apply ultrasonic vibration to settling tank 50. After the treatment liquid is conveyed from treatment tank 1 to settling tank 50, ultrasonic vibrating machine 51 is driven, and settling tank 50 undergoes ultrasonic vibration. By this vibration, the oil content in the treatment liquid moves upward and floats on the liquid surface, whereas the chemical sludge moves downward and settles down to the bottom of the tank 50. Thus, ultrasonic vibrating machine 51 can promote separation of oil, chemical sludge and dust particles in the treatment liquid. Therefore, settling tank 50 can remove these unwanted substances during a downtime of one or two days.

Settling tank 50 of this example is further provided with an oil removing apparatus 52 for sucking oil floating on the liquid surface and removing the oil. Piping 53 is arranged to suck the treatment liquid at the level near the liquid surface in settling tank 50 and to return the treatment liquid to settling tank 50 through oil removing apparatus 52. A pump 54 for sucking the treatment liquid is disposed in the piping 53. As oil removing apparatus 52, it is possible to employ any one or more of the above-mentioned heating oil removing apparatus, coalescer oil removing apparatus, and ultrafiltration oil removing apparatus.

A hopper 50*a* is formed at the bottom of settling tank 50, for collecting and sucking the chemical sludge sinking toward the bottom. A pump 57 sucks the treatment liquid replete with chemical sludge through piping 56, and delivers the liquid to a sludge removing apparatus 55 for removal of the chemical sludge. As sludge removing apparatus 55 like sludge removing apparatus 3, it is possible to employ any filter as long as it can maintain the sludge concentration within 150 ppm in the treatment liquid without contaminating the treatment liquid. After removal of the chemical sludge, the treatment liquid is returned to settling tank 50 through piping 56. Dust having greater specific gravity such as iron powder settles down to the bottom of settling tank 50, and hence the chemical sludge removing apparatus 55 removes heavy dust together with chemical sludge.

The addition of settling tank 50 as in the third and fourth embodiments is effective for removing oil, chemical sludge, and dust or dust particles such as iron particles, and maintaining the treatment liquid clean while the production line is not operating. The third and fourth embodiments can improve the performance of the degreasing and chemical conversion treatment, and hence improve the quality of work to be painted. The addition of settling tank 50 functions to lighten the load on the dust removing section 2, sludge removing section 3 and oil removing section 4 used while the production line is operating.

Figure 12:
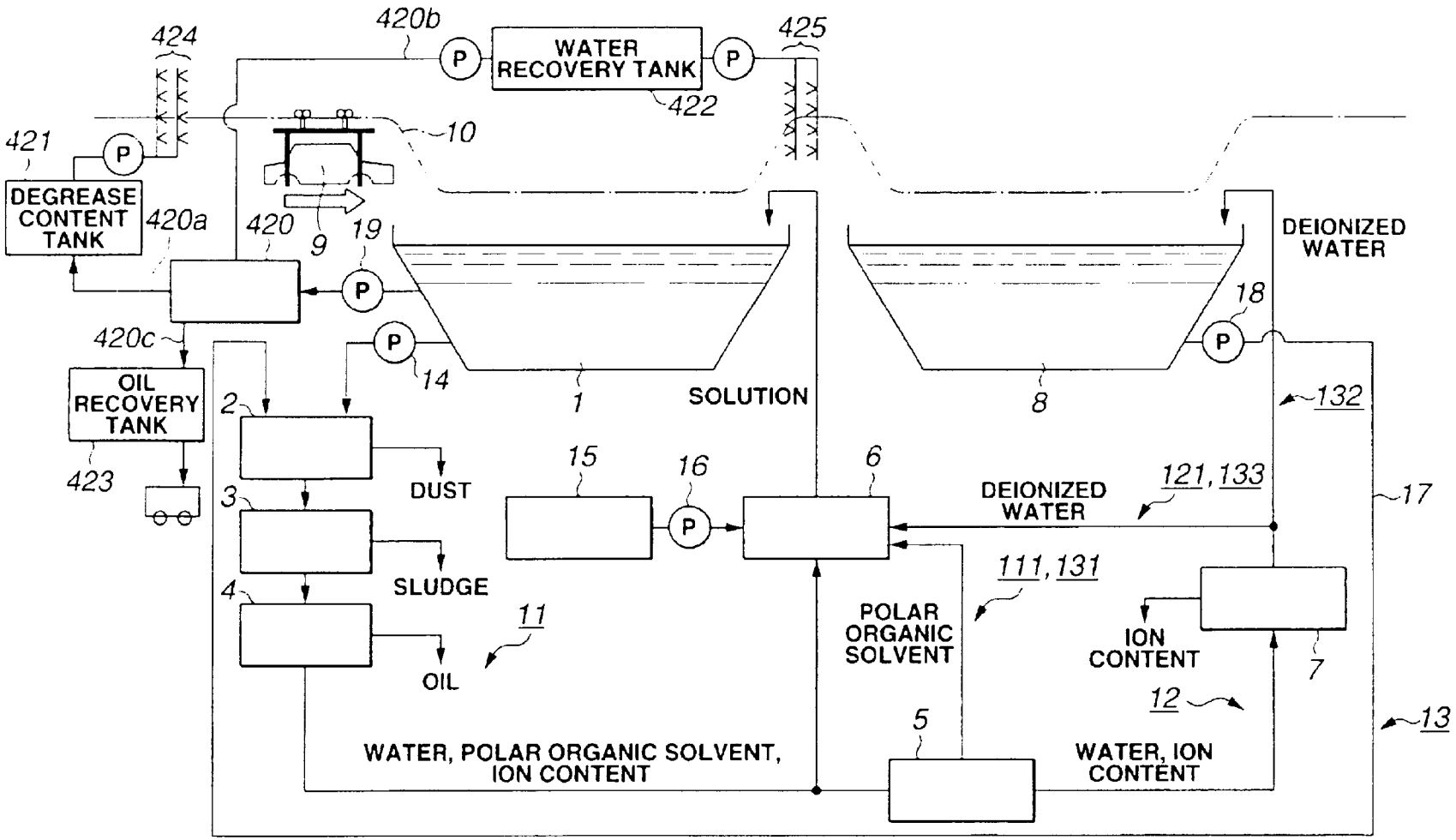
FIG. 12 is a schematic view showing a pretreatment apparatus (or equipment) according to a fifth embodiment of the present invention.

FIG. 12 shows a pretreatment apparatus according to a fifth embodiment of the present invention. The pretreatment apparatus of FIG. 12 is similar to the apparatus of FIG. 1. However, the apparatus of FIG. 12 includes a vacuum distillation apparatus 420 and at least one spray zone (424 or 425).

As shown in FIG. 12, a pump 19 sucks the treatment liquid from treatment tank 1 and supplies the treatment liquid to vacuum distillation apparatus 420. Under the condition of reduced pressure, vacuum distillation apparatus 420 separates the polar organic solvent, water and oil of the treatment liquid.

A degreased content tank 421 temporarily stores the polar organic solvent separated by vacuum distillation apparatus 420. A first spray zone 424 sprays this polar organic solvent to a vehicle body 9 at a stage prior to the stage of treatment tank 1.

A water recovery tank 422 temporarily stores the water separated by vacuum distillation apparatus 420. A second spray zone 425 sprays this water to vehicle body 9 at a stage following the stage of treatment tank 1. Oil and sludge remaining after the separation of the polar organic solvent and water are collected in an oil recovery tank 423.

Thus, the polar organic solvent, water and remaining component of the treatment liquid are separated, and conveyed by the following three different flows. The flow of the polar organic solvent is: treatment tank 1→vacuum distillation apparatus 420→degreased component tank 421→first spray zone 424. The flow of water is: treatment tank 1→vacuum distillation apparatus 420→water recovery tank 422→second spray zone 425 (or rinse tank 8 or to treatment liquid supply tank 6). The flow of the remaining component including oil component is: treatment tank 1→vacuum distillation apparatus 420→oil recovery tank 423.

Vacuum distillation apparatus 420 of this example is identical in construction to vacuum distillation apparatus 20 shown in FIG. 8. In the pretreatment apparatus of FIG. 12, the polar organic solvent separated by first vacuum distillation apparatus 201 shown in FIG. 8 is supplied to degreased component tank 421 and first spray zone 424. The water separated by second vacuum distillation apparatus 202 is supplied to water recovery tank 422 or second spray zone 425. Moreover, the pretreatment apparatus may be arranged so that the water separated by second vacuum distillation apparatus 202 following first vacuum distillation apparatus 201 is further supplied to supply tank 6 and/or rinse tank 8. The dust, sludge and oil as separated in vacuum distillation apparatus 202 are disposed of properly.

The lowering of the boiling point by the reduction of the pressure makes it possible to reduce the required amount of heat energy supplied to each heater 205 as compared to the distillation at a normal pressure. Specifically, it is desirable to employ waste heat from a paint drying furnace or oven as a source of heat energy for the heaters 205.

At first spray zone 424, the degreased component containing polar organic solvent is sprayed by shower nozzles to vehicle body 9 to be dipped in treatment tank 1 at the next stage. The degreased component is applied to the inside and outside of vehicle body 9, to remove oil from the surfaces. First spray zone 424 for spraying polar organic solvent to work before the operation of treatment tank 1 is effective to promote the degreasing operation and thereby to prevent failure in chemical conversion coating.

At second spray zone 425, water is sprayed by shower nozzles to vehicle body 9 taken out from treatment tank 1. Water reaches the inside and outside of the vehicle body 9, and washes out the treatment liquid from the surfaces. Second spray zone 425 for spraying water to vehicle body 9 after the pretreatment at treatment tank 1 is effective to clean off the treatment liquid before the next dipping step at rinse tank 8, and thereby to prevent the treatment liquid from entering rinse tank 8.

Oil separated and recovered can be subjected to fractional distillation to separate components of different boiling points, which can be used as fuel or rust preventing agent. Vacuum distillation apparatus 420 is advantageous in simplifying the system and reducing the cost.

Figure 13:
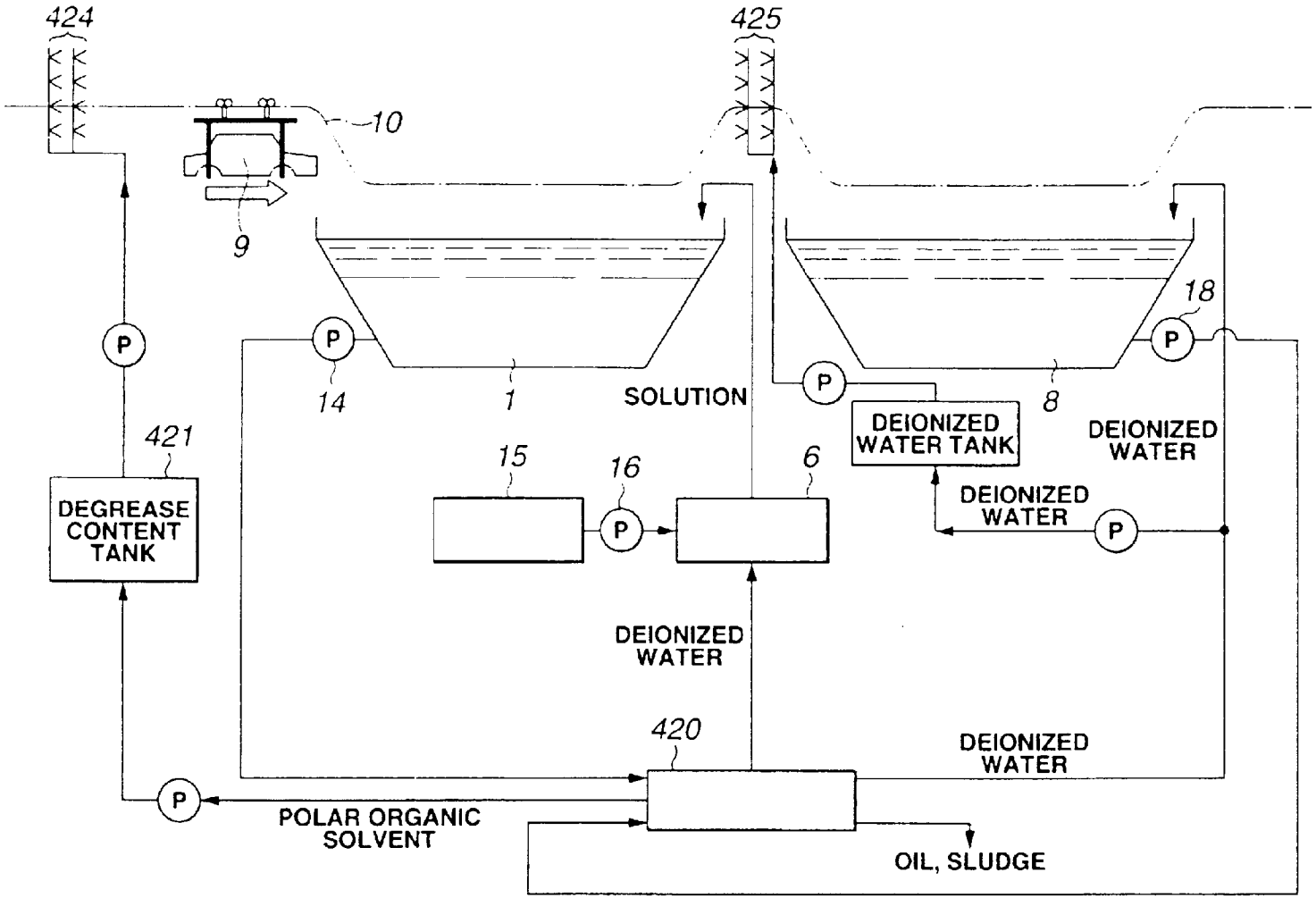
FIG. 13 is a schematic view showing a pretreatment apparatus (or equipment) according to a sixth embodiment of the present invention.

FIG. 13 shows a pretreatment apparatus according to a sixth embodiment of the present invention. The treatment liquid is sucked from treatment tank 1 by a pump 14, and supplied to a vacuum distillation apparatus 420. The rinsing liquid is sucked from rinse tank 8 by a pump 18, and supplied to vacuum distillation apparatus 420. Vacuum distillation apparatus 420 separates the polar organic solvent, water and remaining component. The polar organic solvent is conveyed from vacuum distillation apparatus 420 to a degreased content tank 421. From degreased content tank 421, the polar organic solvent is supplied to a first spray zone 424 as in the fifth embodiment of FIG. 12. On the other hand, water separated from the treatment liquid is supplied from vacuum distillation apparatus 420, partly to treatment liquid supply tank 6 and partly to a second spray zone 425 through a water tank. The remaining water is supplied to rinse tank 8. Vacuum distillation apparatus 420 shown in the example of FIG. 13 is identical in construction to vacuum distillation apparatus 420 shown in FIG. 12.

Figure 14:
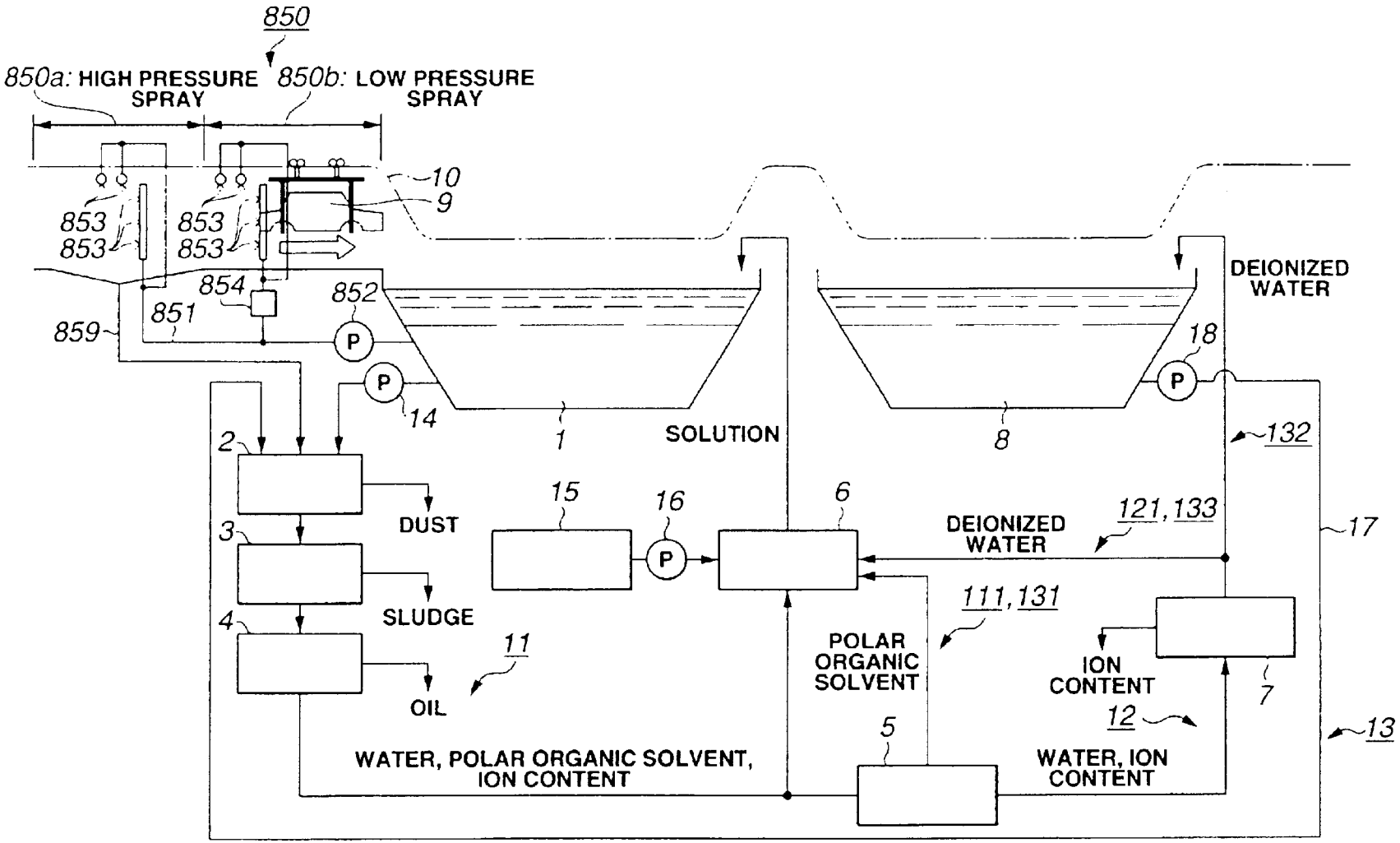
FIG. 14 is a schematic view showing a pretreatment apparatus (or equipment) according to a seventh embodiment of the present invention.

FIG. 14 shows a pretreatment apparatus according to a seventh embodiment of the present invention. The apparatus of FIG. 14 is similar to the apparatus shown in FIG. 1, and has all the components shown in FIG. 1 like the apparatus of FIG. 9 and FIG. 12. The apparatus of FIG. 14 further includes a spray zone 850 disposed at a stage immediately before the stage of treatment tank 1.

Spray zone 850 of the example shown in FIG. 14 includes a high pressure spray zone 850*a* disposed at a preceding stage, and a low pressure spray zone 850*b* disposed at a stage following the preceding stage of high pressure spray zone 850*a*. Each spray zone 850*a* or 850*b* includes a plurality of nozzles 853 attached to piping 851 and arranged to spray the treatment liquid to vehicle body 9. The treatment liquid is supplied to each spray zone from treatment tank 1 by a pump 852. In the example of FIG. 14, a booth for spray in each spray zone has overhead nozzles 853 for spraying from above, and side nozzles 853 for spraying sidewise, and is arranged mainly to spray the treatment liquid to outside panels of vehicle body 9 (such as hood, roof, trunk lid, front fenders, doors and rear fenders).

The treatment liquid sprayed at high pressure zone 850*a* tends to contain a large amount of oil and dust particles. Therefore, the floor of high pressure spray zone 850*a* has sloping surfaces meeting at a deepest center to collect the treatment liquid sprayed to vehicle body 9, and convey the treatment liquid to the before-mentioned dust removing section 2. Low pressure spray zone 850*b* may be arranged to collect the treatment liquid and convey the treatment liquid to dust removing section 2 in the same manner, or may be arranged to return the treatment liquid used in low pressure spray zone 850*b* directly to treatment tank 1 because the content of oil and dust in the treatment liquid used in low pressure zone is relatively low.

In the example of FIG. 14, there is provided, in the pipe line to nozzles 853 of low pressure spray zone 850*b*, a regulator 854 for regulating the pressure in the pipe line produced by pump 52. By operating regulator 54, it is possible to regulate the discharge pressure from nozzles 853 in low pressure spray zone 850*b*.

In this example, the preceding high pressure spray zone 850*a* mainly functions to remove oil from outside panels of vehicle body 9, and the next low pressure spray zone 850*b* mainly performs surface conditioning and chemical treatment. Accordingly, the discharge pressure of the nozzles 853 in high pressure spray zone 850*a* is at a high level of about 3.92 MPa, whereas the discharge pressure of the nozzles 853 in low pressure spray zone 850*b* is in a low pressure range of 294 kPa~490 kPa. The high pressure spray of the treatment liquid in high pressure spray zone 850*a* is effective to wash away oil and dust from the outside panels of vehicle body, and the low pressure spray in low pressure spray zone 850*b* is effective to condition the surfaces of vehicle body 9 properly and to form chemical conversion coating.

In this way, spray zone 850 performs the degreasing and chemical treatment before the dipping operation in treatment tank 1. Therefore, in treatment tank 1, the degreasing and chemical conversion proceed in remaining outside panels and inside panels of vehicle body 9. Spray zone 850 improves the performance of degreasing and chemical conversion in treatment tank 1. Each of high pressure spray zone 850*a* and low pressure spray zone 850*b* can be achieved only in a space of a length corresponding to the length of a single vehicle body. The addition of spray zone 850 does not increase the length of the entire pretreatment process so much. A pipe or conduit member 859 shown in FIG. 14 is arranged to convey the collected treatment liquid from spray zone 850 to the impurity removing section including sections 2, 3 and 4.

Figure 15:
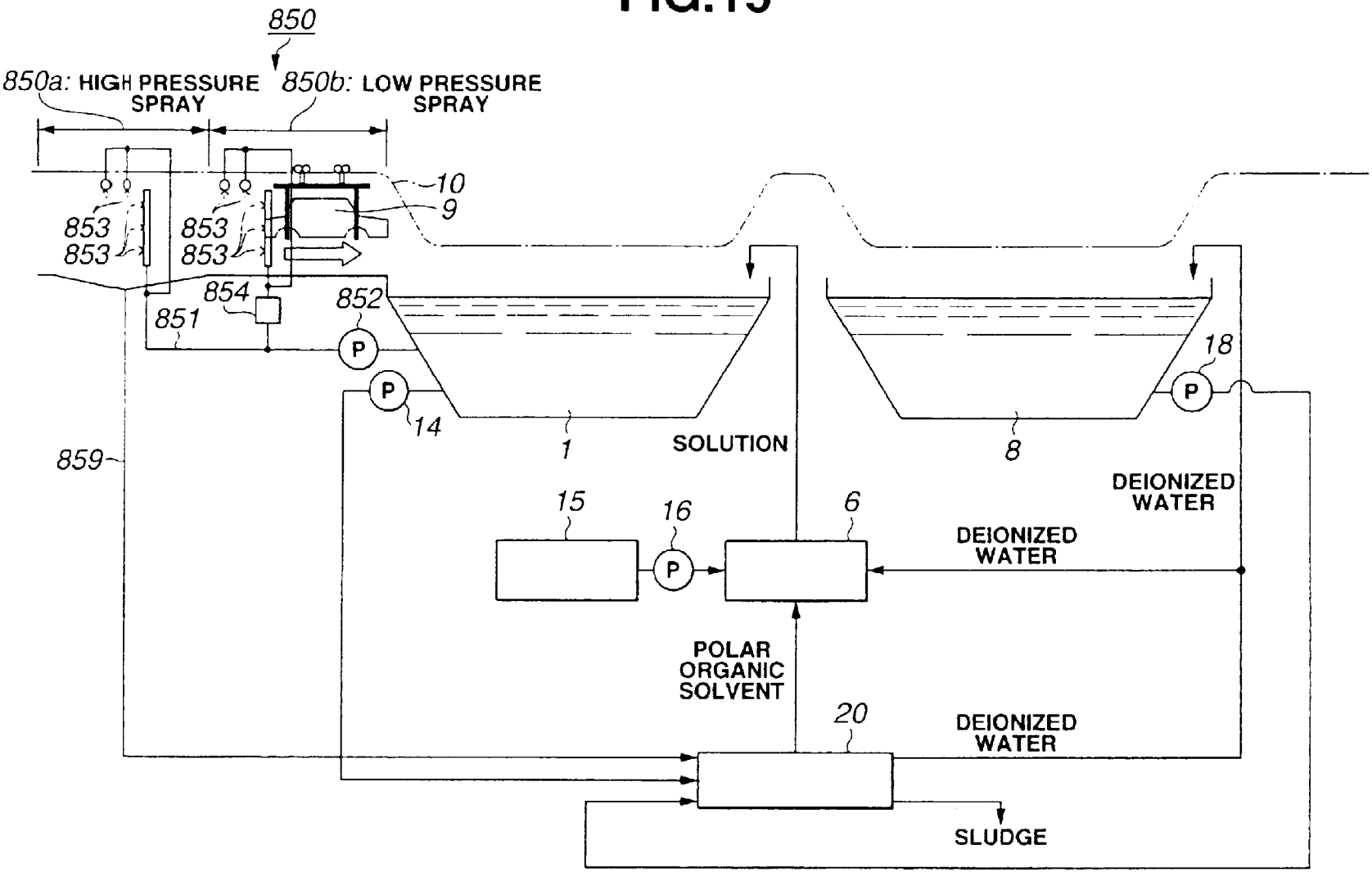
FIG. 15 is a schematic view showing a pretreatment apparatus (or equipment) according to an eighth embodiment of the present invention.

FIG. 15 shows a pretreatment apparatus according to an eighth embodiment of the present invention. The pretreatment apparatus of FIG. 15 has the spray zone 850 of high pressure spray zone 850*a* and low pressure spray zone 850*b* which is substantially identical to the spray zone 850 shown in FIG. 14. In the example of FIG. 15, the treatment liquid collected in spray zone 850 is conveyed to a vacuum distillation apparatus 20 substantially identical to the vacuum distillation apparatus 20 shown in FIGS. 7 and 8. Except for spray zone 850, the pretreatment apparatus of FIG. 15 is identical to the apparatus of FIG. 7.

In the seventh and eighth embodiments, the spray zone 850 may be arranged to include only one spray zone of a single discharge pressure, instead of including high pressure and low pressure spray zones of two different discharge pressures. In the seventh and eighth embodiment, the treatment liquid collected in spray zone 850 is led to the before-mentioned first circulation path 11. However, it is optional to provide an additional circulation path for spray zone 850 and to provide, in this additional circulation path, an impurity removing section including a dust removing section similar to section 2, a chemical sludge removing section similar to section 3 and an oil removing section similar to section 4.

In the illustrated embodiments of the present invention, first (or treatment-side) circulation path 11 functions to circulate the treatment liquid in a closed circuit, and by so doing, contributes to reduction in material cost. By the use of treatment liquid or solution combining the function of degreasing and the function of chemical conversion, the pretreatment apparatus can achieve the degreasing operation and chemical treatment simultaneously at one step. Therefore, the pretreatment apparatus can reduce the space required for the equipment, reduce the cost of equipment and improve the productivity by shortening the time for the pretreatment. Moreover, the use of this multifunction treatment liquid makes it possible to reduce the manhour for control and management of conditions of the pretreatment. Furthermore, it is possible to simplify the water rinsing step, to reduce the required amount of rinsing liquid and to reduce the burden on the waste water treatment. Dust removing apparatus 2 may be provided in first circulation path 11 or may be outside first circulation path, for example, inside or outside treatment tank 1. Oil removing apparatus may be placed outside circulation path. It is possible to arrange the dust removing apparatus 2, sludge removing apparatus 3 and oil removing apparatus 4 in various orders other than the order shown in FIG. 1.

Second (rinse-side) circulation path 12 functions to circulate the treatment liquid in a closed circuit, and by so doing, contributes to reduction in material cost, and reduction in burden on the waste water treatment. Third circulation path 13 functions to circulate the rinsing liquid in a closed circuit, and by so doing, contributes to reduction in material cost, and reduction in burden on the waste water treatment.

Treatment tank 1 corresponds to means for storing the treatment liquid for degreasing and chemical conversion. At least one of items 11*a*, 11*b*, 11*c*, 12*a*, 12*b*, 14, 17, 18, 111*a* and 121*a* corresponds to means for defining a circulation path or a circuit section. At least one of items 2, 3, 4, 5, 7, 20 and 420 corresponds to means for removing at least one of dust, chemical sludge and oil content from the treatment liquid, or to a purifying section.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

TABLE 1

| Number of sheets as treated | | 1 | 100 | 250 | 500 | 750 | 1000 | 1250 | 1500 | 1750 | 2000 |
|---|---|---|---|---|---|---|---|---|---|---|---|
| Example 1 | Oil coating 0.5 g/cm$^2$ | ◎ | ◎ | ◎ | ◎ | ◎ | ◎ | ◎ | ◎ | ◎ | ◎ |
| Example 2 | Oil coating 1 g/cm$^2$ | ○ | ○ | ○ | ○ | ○ | ○ | ○ | ○ | ○ | ○ |
| Example 3 | Oil coating 2 g/cm$^2$ | ○ | ○ | ○ | ○ | ○ | ○ | ○ | ○ | ○ | ○ |
| Comparative Example 1 | Beaker treatment | ○ | Δ | X | X | X | X | X | X | X | X |
| Comparative Example 2 | Degreasing | ◎ | ◎ | ◎ | ◎ | ◎ | ◎ | ◎ | ◎ | ◎ | ◎ |

What is claimed is:

1. A pretreatment apparatus for performing pretreatment before a painting process, the pretreatment apparatus comprising:

a liquid container section including a treatment section which includes a treatment tank to store a treatment liquid for degreasing and chemical conversion;

a circuit section to form a circulation path for circulating the treatment liquid from the treatment tank to the liquid container section; and a purifying section to remove an unwanted constituent from the treatment liquid circulated to the container section through the circulation path, wherein the purifying section is a section to remove dust, chemical sludge and oil, and the purifying section comprises a sludge removing section disposed in the circulation path, and arranged to remove the chemical sludge from the treatment liquid, wherein the liquid container section further comprises a rinse tank disposed at a stage following a stage of the treatment tank, and arranged to store a rinsing liquid, wherein the purifying section comprises: a separating section disposed in the circulation path for circulating the treatment liquid from the treatment tank to the liquid container section, and arranged to receive the treatment liquid and to separate a polar organic solvent and a water content in the treatment liquid, wherein the circuit section comprises a circuit member to form a rise-side circulation path to return the treatment liquid to the rinse tank, and wherein the purifying section further comprises:

a dust removing section, disposed in the rise-side circulation path, and arranged to remove dust from the treatment liquid for degreasing and chemical conversion; and an oil removing section disposed in the rise-side circulation path, and arranged to remove an oil content from the treatment liquid.

2. The pretreatment apparatus as claimed in claim 1, wherein the circulation path to return the treatment liquid to the liquid container section comprises a treatment-side circulation path to suck the treatment liquid from the treatment tank and to return the treatment liquid to the treatment tank; and wherein the treatment section further comprises a supply task disposed in the treatment-side circulation path and arranged to receive the treatment liquid purified by the sludge removing section and to supply the treatment liquid purified by the sludge removing section, to the treatment tank.

3. The pretreatment apparatus as claimed en claim 2, wherein the purifying section further comprises:

a dust removing section to remove dust from the treatment liquid for degreasing and chemical conversion;

an oil removing section to remove an oil content from the treatment liquid.

4. The pretreatment apparatus as claimed in claim 3, wherein the dust removing section, and the oil removing section are disposed in the circulation path for circulating the treatment liquid from the treatment tank to the liquid container section.

5. The pretreatment apparatus as claimed in claim 2, wherein the purifying section further comprises a separating section to receive the treatment liquid for degreasing and chemical conversion, and to separate a polar organic solvent and a water content in the treatment liquid.

6. The pretreatment apparatus as claimed in claim 1, wherein the purifying section comprises: a separating section disposed in the circulation path for circulating the treatment liquid from the treatment tank to the liquid container section, and arranged to receive the treatment liquid and to separate a polar organic solvent and a water content in the treatment liquid.

7. The pretreatment apparatus as claimed in claim 6, wherein the circuit section comprises a circuit member to for a rise-side circulation path to return the treatment liquid to the rinse tank.

8. The pretreatment apparatus as claimed in claim 7, wherein the purifying section further comprises an ion removing section disposed in the rinse-side circulation path, and arranged to remove an ion content from the water content separated by the separating section and to return a deionized water remaining after the separation of the ion content from the water content, to the rinse tank.

9. The pretreatment apparatus as claimed in claim 8, wherein the treatment section further comprises a supply tank to supply the treatment liquid to the treatment tank; and wherein the circuit section comprises a circuit member to form a circuit path to convey at least part of the deionized water obtained by the ion removing section, to the supply tank.

10. The pretreatment apparatus as claimed in claim 6, wherein the circuit section comprises a circuit member to form a solvent circuit path to return the polar organic solvent to the treatment section.

11. The pretreatment apparatus as claimed in claim 10, wherein the circuit section comprises a circuit member to form a treatment-side circulation path to return the treatment liquid purified by the sludge removing section, to the treatment tank without passing through the separating section.

12. The pretreatment apparatus as claimed in claim 11, wherein the treatment section further comprises a supply tank to supply the treatment liquid to the treatment tank; and wherein the supply tank is connected with the treatment-side circulation path, and the solvent circuit path to return the polar organic solvent to the treatment tank.

13. The pretreatment apparatus as claimed in claim 10, wherein the circuit section comprises a circuit member to form a rinse-side circulation path to return the water content to the rinse tank.

14. The pretreatment apparatus as claimed in claim 1, wherein the circuit section comprises:

a circuit member to form a rinse return path to return the rinsing liquid from the rinse tank to the purifying section; and a circuit member to form the circulation path for circulating the treatment liquid from the treatment tank to the liquid container section.

15. The pretreatment apparatus as claimed in claim 14, wherein the purifying section further comprises:

a dust removing section disposed in the circuit path, and arranged to remove dust from the treatment liquid for degreasing and chemical conversion;

an oil removing section disposed in the circuit path and arranged to remove an oil content from the treatment liquid; and wherein the rinse return path is arranged to return the rinsing liquid from the rinse tank to the purifying section so that the rinsing liquid flows through all of the dust removing section, the sludge removing section and the oil removing section.

16. The pretreatment apparatus as claimed in claim 1, wherein the purifying section comprises a vacuum distillation apparatus to separate a polar organic solvent from the treatment liquid, and the pretreatment apparatus further comprises a first spray zone, disposed at a stage prior to a stage of the treatment tank, and arranged to spray the polar organic solvent to a work to be painted.

17. The pretreatment apparatus as claimed in claim 16, wherein the vacuum distillation apparatus is arranged to separate water from the treatment liquid, and the pretreatment apparatus further comprises a second spray zone disposed at a stage following the stage of the treatment tank, and arranged to spray water to the work to be painted.

18. The pretreatment apparatus as claimed in claim 16, wherein the vacuum distillation apparatus comprises a section to utilize a waste heat of a drying oven for a painting process.

19. The pretreatment apparatus as claimed in claim 16, wherein the liquid container section further comprises a rinse tank disposed at a stage following the stage of the treatment tank, and arranged to store a rinsing liquid, and the circuit section comprises a circuit member to form a path to convey water from the vacuum distillation apparatus to the rinse tank.

20. The pretreatment apparatus as claimed in claim 19, wherein the liquid container section further comprises a supply tank to supply the treatment liquid to the treatment tank, and the circuit section comprises a circuit member forming a path to convey water from the vacuum distillation apparatus to the supply tank.

21. The pretreatment apparatus s claimed in claim 1, wherein the purifying section comprises a separating section for separating a polar organic solvent and a water content by pervaporation.

22. The pretreatment apparatus as claimed in claim 21, wherein the purifying section comprises an ion removing section for removing an ion content from the water content, and wherein the ion removing section comprises a first cation exchange subsection including a first cation exchange resin, an anion exchange subsection including an anion exchange resin, a second cation exchange subsection including a second cation exchange resin and a decarboxylating subsection.

23. The pretreatment apparatus as claimed in claim 22, wherein the first cation exchange resin is a chelating cation exchange resin, the anion exchange resin is a styrene strongly basic anion exchange resin, and the second cation exchange resin is a styrene strongly acidic cation exchange resin.

24. The pretreatment apparatus as claimed in claim 1, wherein the liquid container section further comprises a rinse tank and a supply tank, the purifying section comprises a vacuum distillation section to receive the treatment liquid, to separate a polar organic solvent, a water content and remaining dust, and to supply the polar organic solvent to the supply tank and the water content to the supply tank and the rinse tank.

25. The pretreatment apparatus as claimed in claim 24, wherein the vacuum distillation section comprises a section to utilize a waste heat of a drying oven in a painting.

26. The pretreatment apparatus as claimed in claim 1, wherein the purifying section comprises a dust removing section to remove dust from the treatment liquid; and wherein the dust removing section includes at least one of a settling tank, a centrifugal separator and a magnetic separator.

27. The pretreatment apparatus as claimed in claim 1, wherein the purifying section comprises a sludge removing section to remove chemical sludge from the treatment liquid; and wherein the sludge removing section comprises a filter for dead end filtration to hold a sludge concentration in the treatment liquid in the treatment tank equal to or lower than 150 ppm.

28. The pretreatment apparatus as claimed in claim 1, wherein the treatment liquid for degreasing and chemical conversion contains a polar organic solvent, a water content and an ion content; wherein the polar organic solvent is a polar organic solvent selected from the group consisting of alcohols, glycol ethers and diethylene glycol ethers; and wherein the ion content contains at least ions selected from the group consisting of zinc ions, phosphoric acid ions, manganese ions, nickel ions and sodium ions.

29. The pretreatment apparatus as claimed in claim 1, wherein the purifying section comprises an oil removing section to remove oil from the treatment liquid; and wherein the oil removing section comprises at least one of a heating oil removing apparatus, coalescer oil removing apparatus and an ultrafiltration oil removing apparatus.

30. The pretreatment apparatus as claimed in claim 1, wherein the pretreatment apparatus further comprises;

a settling tank to receive the treatment liquid from the treatment tank; and a purifying apparatus to separate an unwanted constituent from the treatment liquid in settling tank.

31. The pretreatment apparatus as claimed in claim 30, wherein the purifying apparatus comprises an ultrasonic vibrating machine to vibrate the settling tank to provide ultrasonic vibration to the settling tank, and to separate at least one of oil and chemical sludge from the treatment liquid.

32. The pretreatment apparatus as claimed in claim 30, wherein the pretreatment apparatus further comprises an oil removing apparatus to remove oil from the treatment liquid in settling tank.

33. The pretreatment apparatus as claimed in claim 30, wherein the pretreatment apparatus further comprises a chemical sludge removing apparatus to remove chemical sludge from the treatment liquid in settling tank.

34. The pretreatment apparatus as claimed in claim 1, wherein the pretreatment apparatus further comprises a spray zone, disposed at a stage prior to a stage of the treatment tank, and arranged to spray a spray liquid for degreasing and chemical conversion to a work to be painted.

35. The pretreatment apparatus as claimed in claim 34, wherein the spray zone comprises a first spray zone to spray the spray liquid to the work at a higher pressure, and a second spray zone disposed at a stage following a stage of the first spray zone, and arranged to spray the spray liquid to work at a lower pressure lower than the higher pressure.

36. The pretreatment apparatus as claimed in claim 34, wherein the spray zone comprises a collecting section to collect the spray liquid sprayed in the spray zone, and to supply the spray liquid to the purifying section.

37. The pretreatment apparatus as claimed in claim 36, wherein the pretreatment apparatus comprises a conduit member to convey the treatment liquid from the liquid container section to the spray zone so that the treatment liquid is used as the spray liquid.

38. The pretreatment apparatus as claimed in claim 34, wherein the purifying section comprises a conduit member to convey the spray liquid from the spray zone to a section to purify the spray liquid.

39. A pretreatment apparatus for performing pretreatment before a painting process, the pretreatment apparatus comprising:

a liquid container section including a treatment section which includes a treatment tank to store a treatment liquid for degreasing and chemical conversion;

a circuit section to form a circulation path for circulating the treatment liquid from the treatment tank to the liquid container section; and a purifying section to remove an unwanted constituent from the treatment liquid circulated to the container section through the circulation path, wherein the purifying section is a section to remove dust, chemical sludge and oil, and the purifying section comprises a sludge removing section disposed in the circulation path, and arranged to remove the chemical sludge from the treatment liquid, wherein the liquid container section further comprises a rinse tank disposed at a stage following a stage of the treatment tank, an arranged to store a rinsing liquid, wherein the purifying section comprises: a separating section disposed in the circulation path for circulating the treatment liquid from the treatment tank to the liquid container section, and arranged to receive the treatment liquid and to separate a polar organic solvent and a water content in the treatment liquid, wherein the circuit section comprises a circuit member to form a rise-side circulation path to return the treatment liquid to the rinse tank, and wherein the separating section includes a first vacuum distillation section to separate the polar organic solvent and direct the polar organic solvent to the treatment section, and the sludge removing section includes a second vacuum distillation section to separate the chemical sludge from the water content, and to direct the water content to the rinse tank.

40. The pretreatment apparatus as claimed in claim 39, wherein the treatment section further comprises a supply tank to supply the treatment liquid to the treatment tank; and wherein the circuit section comprises a circuit member to form a water circuit path to convey at least part of the water content from the second vacuum distillation section to the supply tank.

41. A pretreatment apparatus for performing pretreatment before a painting process, the pretreatment apparatus comprising:

a liquid container section including a treatment section which includes a treatment tank to store a treatment liquid for degreasing and chemical conversion;

a circuit section to form a circulation path for circulating the treatment liquid from the treatment tank to the liquid container section; and a purifying section to remove an unwanted constituent from the treatment liquid circulated to the container section through the circulation path, wherein the purifying section is a section to remove dust, chemical sludge and oil, and the purifying section comprises a sludge removing section disposed in the circulation path, and arranged to remove the chemical sludge from the treatment liquid, wherein the liquid container section further comprises a rinse tank disposed at a stage following a stage of the treatment tank, an arranged to stare a rinsing liquid, wherein the purifying section comprises: a separating section disposed in the circulation path for circulating the treatment liquid from the treatment tank to the liquid container section, and arranged to receive the treatment liquid and to separate a polar organic solvent and a water content in the treatment liquid, wherein the circuit section comprises a circuit member to form a solvent circuit path to return the polar organic solvent to the treatment section, wherein the circuit section comprises a circuit member to form a rinse-side circulation path to return the water content to the rinse tank, and wherein the purifying section further comprises an ion removing section disposed in the rinse-side circulation path, and arranged to remove an ion content from the water content separated by the separating section and to return a deionized water remaining after the separation of the ion content from the water content, to the rinse tank.

42. A pretreatment apparatus for performing pretreatment before a painting process, the pretreatment apparatus comprising:

a liquid container section including a treatment section which includes a treatment tank storing a treatment liquid for degreasing and chemical conversion;

a circuit section to form a circulation path for circulating the treatment liquid from the treatment tank to the liquid container section; and a purifying section to remove an unwanted constituent from the treatment liquid circulated to the container section through the circulation path, wherein the purifying section is a section to remove dust, chemical sludge and oil, and the purifying section comprises a sludge removing section disposed in the circulation path, and arranged to remove the chemical sludge from the treatment liquid, wherein the purifying section further comprises a separating section disposed in the circulation path for circulating the treatment liquid from the treatment tank to the liquid container section, and arranged to receive the treatment liquid and to separate a polar organic solvent and a water content in the treatment liquid, wherein the liquid container section further comprises a rinse tank disposed at a stage following a stage of the treatment tank, and arranged to store a rinsing liquid, wherein the circuit section comprises a circuit member to form a solvent circuit path to return the polar organic solvent to the treatment section and a circuit member to form a rinse-side circulation path to return the water content to the rinse tank, wherein the separating section includes a first vacuum distillation section to separate the polar organic solvent and direct the polar organic solvent to the treatment section, and the sludge removing section includes a second vacuum distillation section to separate the chemical sludge from the water content, and to direct the water content to the rinse tank.

43. A pretreatment apparatus for performing pretreatment before a painting process for an automobile body, the pretreatment apparatus comprising:

means for performing chemical conversion on the automobile body to prepare for the painting process, with a treatment liquid for the chemical conversion, and for degreasing the automobile body simultaneously with the chemical conversion in a pretreatment stage, the treatment liquid being stored in a pretreatment liquid storing space;

means for rinsing the automobile body after the pretreatment stage before the painting process, with a rinsing liquid stored in a rinsing liquid storing space;

means for defining a treatment-side circulation path for circulating the treatment liquid from the treatment liquid storing space, to the treatment liquid storing space, and a rinse-side circulation path for returning the treatment liquid to the rinsing liquid storing space; and means for removing at least one of dust, chemical sludge and oil content from the treatment liquid circulated through the circulation path, the removing means including, means disposed in the rinse-side circulation path, for removing dust from the treatment liquid, and means disposed in the rinse-side circulation path, for removing an oil content from the treatment liquid.

44. A painting system for painting an automobile body, the painting system comprising:

a conveyor extending through a pretreatment stage and rinsing stage following the pretreatment stage, to a painting stage, to carry an automobile body through the pretreatment stage and the rinsing stage, to the painting stage for painting the automobile body after the rinsing stage;

a treatment tank disposed at the pretreatment stage, to store a treatment liquid and to perform chemical conversion and degreasing for the automobile body simultaneously with the treatment liquid for decreasing and chemical conversion;

a rinse tank disposed at the rinsing stage following the pretreatment stage, to store a rinsing liquid for rinsing the automobile body after the pretreatment stage;

a circuit section to form a circulation path for circulating the treatment liquid from the treatment tank, to the treatment tank and the rinse tank; and a purifying section to remove an unwanted constituent from the treatment liquid circulated to the treatment tank and the rinse tank;

wherein the circuit section includes a circuit member to form a rinse-side circulation path to return the treatment liquid to the rinse tank; and wherein the purifying section includes, a dust removing section, disposed in the rise-side circulation path, and arranged to remove dust from the treatment liquid for degreasing and chemical conversion, an oil removing section disposed in the rise-side circulation path, and arranged to remove an oil content from the treatment liquid.

45. The painting system as claimed in claim 44, wherein the rinse tank is separated from the treatment tank so that the rinsing liquid is not introduced into the treatment tank without passing through the purifying section.

* * * * *